United States Patent [19]

Drummond et al.

[11] 3,942,975

[45] Mar. 9, 1976

[54] METHOD AND APPARATUS FOR REDUCING MATTER TO CONSTITUENT ELEMENTS AND SEPARATING ONE OF THE ELEMENTS FROM THE OTHER ELEMENTS

[75] Inventors: James E. Drummond, Bellevue; David B. Chang, Seattle; Derek W. Mahaffey, Bellevue, all of Wash.

[73] Assignee: The Boeing Company, Seattle, Wash.

[22] Filed: July 7, 1972

[21] Appl. No.: 269,634

Related U.S. Application Data

[63] Continuation-in-part of Ser. No. 172,674, Aug. 18, 1971, abandoned.

[52] U.S. Cl. ..... 75/10 R; 55/100; 204/164; 250/298

[51] Int. Cl. ..... C22d 7/00; B03c 1/10; B01k 1/00

[58] Field of Search ..... 75/.5, 10, 11; 204/164; 55/100, 101; 250/298

[56] References Cited

UNITED STATES PATENTS

| | | | |
|---|---|---|---|
| 2,763,125 | 9/1956 | Kadosch | 55/101 |
| 3,004,158 | 10/1961 | Steimel | 250/298 |
| 3,443,087 | 5/1969 | Robieux | 250/298 |
| 3,522,425 | 8/1970 | Rich | 55/101 |

*Primary Examiner*—L. Dewayne Rutledge
*Assistant Examiner*—Peter D. Rosenberg
*Attorney, Agent, or Firm*—Seidel, Gonda & Goldhammer

[57] ABSTRACT

A method and apparatus for reducing matter, particularly chemical compounds, to constituent elements in a high temperature environment (a plasma) and separating one of the elements from the other elements. Reduction is effected by raising the input compound to a high temperature — thermally disassociating it. Separation is effected by partly ionizing one of the species (elements) to be separated and moving the resultant mixture of gas and plasma at a velocity ($\vec{v}$) through a magnetic field ($\vec{B}$) having a vector component ($\vec{B}_1$) perpendicular to the plasma velocity vector. The interaction of the perpendicular and parallel components of the magnetic field with the ions and electrons in the plasma produces a separating force perpendicular to the direction of plasma flow. The separating force acts on the entire specie which is significantly ionized even though it is only partially ionized. Axial symmetry is maintained so that a space charge does not build up and destroy the flow of electric current in a direction transverse to the plasma flow.

28 Claims, 16 Drawing Figures

FIG. 1
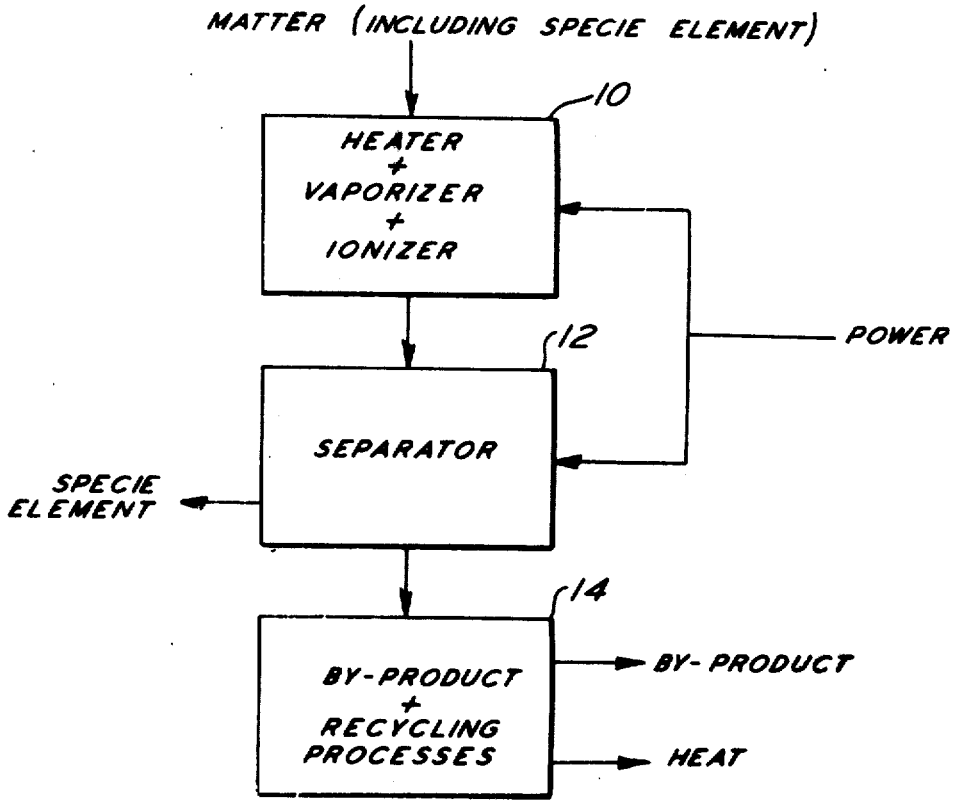
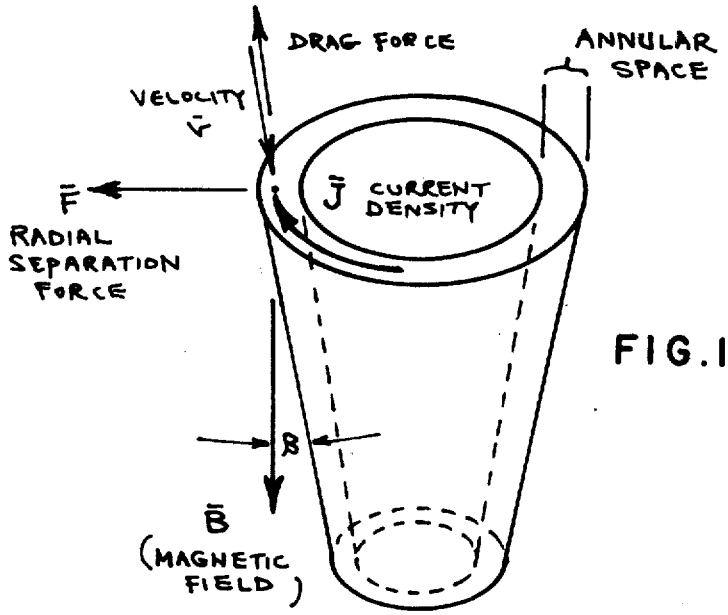
FIG. 12

EQUILIBRIUM COMPOSITION OF $Al_2O_3$ AT 1 atm

EQUILIBRIUM COMPOSITION OF HEMATITE ($Fe_2O_3$) AT 1 ATM atm

EQUILIBRIUM COMPOSITION OF TENORITE ($C_uO$) AT 1 atm

EQUILIBRIUM COMPOSITION OF BUNSENITE (NiO) AT 1 atm

EQUILIBRIUM COMPOSITION OF CASSITERITE ($SnO_2$) AT 1atm.

EQUILIBRIUM COMPOSITION ($FeS_2 \cdot NiS_2$) AT 1 atm

EQUILIBRIUM COMPOSITION OF $Al_2SiO_5$ AT 1 atm.

METHOD AND APPARATUS FOR REDUCING MATTER TO CONSTITUENT ELEMENTS AND SEPARATING ONE OF THE ELEMENTS FROM THE OTHER ELEMENTS

PRIOR PATENT APPLICATIONS

This application is a continuation-in-part of patent application Ser. No. 172,674 filed Aug. 18, 1971 in the name of James E. Drummond, David B. Chang and Derek W. Mahaffey, and now abandoned.

THE DISCLOSURE

Outline of Disclosure

This disclosure has several sections describing the principal parts of the invention. The sections and their headings are chosen for ease of understanding the invention. It is not intended that they be construed in any other manner with respect to the invention which is defined by the claims and according to law.

The sections of the Disclosure are as follows:

I. INTRODUCTION
- A. Generalized Description Of The Invention
- B. Other Separating Processes
- C. Separating Metals From Their Ores And Compounds, Particularly Aluminum From Its Compound, Alumina ($Al_2O_3$)

II. THE DRAWINGS

III. THE SEPARATING PROCESS AND THE SEPARATOR
- A. Introduction
- B. The Apparatus
- C. Detailed Description Of The Separation Process
  1. Magnetofluid Dynamics
  2. Change Exchange
  3. Entrance Effects
  4. Drag
  5. Entrainment
  6. Exemplary Process And Apparatus IV. HEATING AND VAPORIZATION OF THE MATTER
- A. The Arc Heater
- B. Equilibrium Composition Of The Gaseous Mixture

V. COOLING AND CONTAINMENT

VI. REFERENCES

I. INTRODUCTION

A. Generalized Description Of The Invention

This invention relates to a method and apparatus for reducing matter to constituent elements and separating the elements each from the other. More particularly, the invention relates to a method and apparatus for reducing compounds, such as metal oxides, to constituent elements and separating a desired element (e.g., aluminum from oxygen) using high temperature plasmas.

It has been known for some time that compounds will disassociate into their constituent elements at high temperatures. See Varney U.S. Pat. No. 1,954,900[1*]. It is also known that sufficiently high temperatures will cause such elements to ionize [5, 8]. 8. The existence of ionization suggests that it may be possible to separate the constituents, one from the other, using electrical, magnetic or mechanical (e.g., mass difference) processes, or a combination of them. The present invention uses a magnetic field in combination with other factors to accomplish separation in an economically practical manner.

*See list of Prior References Section VI

The degree of ionization at a particular temperature varies from element to element. For example, the ionization potential of aluminum is about 5.98eV and that of oxygen is about 13.61eV. The practical effect of differing ionization potential and other factors (e.g., degeneracy of the lowest ionized state) is that certain elements of high ionization potential do not ionize appreciably at the temperatures where significant ionization of other elements takes place. Examination of the equilibrium composition of a gaseous mixture at elevated temperatures demonstrates that, for certain compounds, after disassociation, one element is partially ionized but the other element or elements are not significantly ionized. The degree of ionization is a monotonically increasing function of temperature.

The present separation process and apparatus operates upon a gas containing only one significantly ionized specie. Separation using only partial ionization means that lower temperatures can be used. Lower temperatures mean less energy input. Analysis shows that throughout rates of production for the selected specie are little affected by ionization fractions as low as several percent. This means that the process is operated at very small percentages of ionization (1–2%) and therefore significantly lower enthalpy relative to those processes which require full ionization (Varney U.S. Pat. No. 1,954,900) while still producing greater quantities of the selected specie. This is made practical by the very rapid (resonant) exchange of charge between atoms and ions of a single specie.

The invented process separates the partly ionized specie from the essentially un-ionized species using a magnetic field. It has been found that a magnetic field at an angle to the direction of flow of the partly ionized gas generates a separating force that operates well at plasma pressures so high that fluid flow rather than molecular flow exists. This is in contrast to the case with the Varney patent. This, together with the large flow velocities permitted produces large throughput rates.

The separator uses an externally generated magnetic field through which the entire plasma including the ions, the electrons and the neutral elements are allowed to flow. More particularly, a magnetic field is oriented at an angle such that it has been perpendicular and parallel components relative to the plasma flow velocity. The interaction of the perpendicular component with the plasma flow velocity produces a current density having both magnitude and direction. The interaction of the current density and the parallel magnetic field component produces a separating force upon the ions and the neutral elements of the same specie that is perpendicular to the plasma velocity. So that a destructive space charge is not built up, the current is allowed to close upon itself. For this, a structure having axial symmetry is provided. The net result is a separating force on the entirety of the partly ionized specie.

Having created a separating force that is active only upon one of the constituent elements, it is possible to isolate that element from the remaining neutral elements. The specie upon which the electromagnetic separation force acts will undergo forced diffusion through the other species and so be concentrated relative to the others in one region of the space. A scoop or cold wall for condensation located in this region completes the separation process. In the latter instance, for example, the ions and neutral elements of the same specie are permitted to strike a relatively cool surface and hence pass from the gaseous to the molten state as described in more detail hereinafter.

B. Other Separating Processes

For decades engineers have sought a plasma means of separating atoms from each other because of the purity obtainable and the high efficiency which ought to apply in removing selected atoms from a gas. In the 1940's the Calutron[2] was used to obtain gram quantities of the then newly discovered fissionable materials. It was essentially a mass spectrograph. In order to remove electric space charge limitations to the rate at which the material could be processed, a plasma was used as the source of ions. This process remained essentially unchanged until 1970 when scientists at the Royal Institute of Technology in Stockholm announced a development from their homopolar fusion research device.[3]. They had found that a rapidly whirling plasma acted like a super high speed centrifuge separating atomic species of different mass. The production rate is greatly increased and the cost reduced over those of the Calutron. The essential change which the Swedish scientists made was to bring the use of plasma into the processing region where bulk magnetofluiddynamic (MFD) processes could be brought to bear. This increased per unit of energy expended. For materials having a high unit value, this was an economically significant result. Yet, for the mundane materials used in enormous volumes by industry, like aluminum, copper, iron, nickel and titanium, it is not competitive with present means of separating those elements from their ores for from scrap. This then appears to be the current state of plasma reduction techniques using mass difference means of separation. Such means of separation may be characterized as separation by mass differences and include the Calutron, centrifuge, and the mass spectrograph.

Another approach is also possible. Instead of separating atoms from the plasma on the basis of mass differences, differences in ionization potential may be used. An example is the research conducted jointly by Columbia University and Bell Telephone Laboratories.[4] There, a low pressure gas mixture was brought into contact with a hot plate. The components of the gas which had low ionization potentials were highly ionized while the other components were not. The device was in a magnetic field so that the ionized fraction moved only along the field direction. The ionized fraction was conducted straight to a collector through holes and baffles with the other components moving in random direction to diffuse slowly through the system by collisions with the walls. The degree of separation could be made very high by proper design because it was based upon the percentage of thermal ionization of one gas component over another. In mass difference devices, the active force causes a separation that is proportional to the fractional mass differences of the components to be separated; but in the Columbia device, separation is proportional to an exponential of the ionization potential difference. This is because the percentage ionization is determined by a Boltzmann factor which has the ionization potential in an exponent. The nature of this is such that a factor of two difference in ionization potential can result in a factor of one hundred difference in percentage ionization.

Unfortunately, this approach to separation in a practical manner is vitiated because the moderate gas pressures which are necessary for reasonable production rates result in such frequent collisions between ions and neutral atoms that the magnetic channeling is virtually eliminated. Channeling is severely reduced by the square of the ratio of the collision frequency to the ion cyclotron frequency. In the present invention this is much greater than unity so there is effectively no separation of species by channeling.

There are other problems with such "quenching" or "cold finger" techniques of separation. One problem is the high reactivity of most metals with oxygen or sulphur (e.g., aluminum with oxygen). Quenching of aluminum alone is therefore rather difficult in the presence of oxygen. Furthermore, a rapid quenching from 5,000°K to about 300°K within the shortest possible distance inside the plasma reactor creates a major engineering problem. If this could be overcome, the products collected would probably be contaminated by oxides requiring much recycling.

The present invention recognizes that the principle of separation using ionization potential differences is valid. Indeed, existing electrolytic separation processes, such as the separation of alumina, $Al_2O_3$, are forms of separation by ionization. The effective ionization potentials of the components to be separated are lowered by the use of a special electrolyte which in the case of alumina is Cryolite. The ionization potential of aluminum is 5.98eV while that of oxygen is 13.61eV. In the electrolyte at 1300°C., the aluminum becomes positively ionized. A voltage is applied to the electrolyte cell and the positive ions are forced through it in one direction. The negative ions are forced to move in the opposite direction. Even allowing for partial recovery of waste heat, the process is less than 50% efficient in modern plants. This leaves room for a sizeable improvement in efficiency. The reason for the inefficiency in the existing process is that aluminum ions have to forced through the electrolyte; that is, the electrolysis takes place in a condensed (liquid) phase. Each molecule of the electrolyte in moving to let an ion pass must in turn move many adjacent molecules with which it is in intimate contact. The process is therefore slow and requires large amounts of energy.

It follows that if the electrolysis could take place in a gaseous phase where most of the space is empty, the resistance of the electrolyte to ionic motion could be greatly reduced. Indeed, the electrolyte can be eliminated altogether in the gas phase since it does not serve its function of lowering the ionization potential of aluminum. But gaseous ionization takes place at very high temperatures. Therefore, the price for lowering resistance to ionic motion is high temperatures in the range of 4000°–8000°K.

Once having achieved ionization, the problem next becomes one of separating the ionized specie from the neutral elements. Separation by mass differences or the various recombination rates characteristic of ions are discussed above. Neither process appears to be an economically feasible technique for metals such as aluminum, iron, titanium and others.

The foregoing outlines other processes for separating selected atoms from a gaseous plasma. Brief mention has been made of the conventional electrolytic process for separating aluminum from its ore because it is somewhat analogous in that it relies upon ionization, but not partial ionization in a gaseous phase. The separation of aluminum is a major example described herein, although the invention is equally applicable to all elements that meet the criteria and fall within the parameters that are established. It is not deemed necessary to describe in detail other existing processes for separating common metals from their ores since such processes are adequately described in the literature and not specifically germane to the invented process.

C. Separating Metals From Their Ores And Compounds, Particularly Aluminum From Its Compound, Alumina ($Al_2O_3$).

The present invention is directed toward separating one element from another. In the embodiments and examples described herein metals are separated from their compounds; i.e., aluminum from alumina ($Al_2O_3$). In such examples it is the partly ionized specie that is the desired product. However, it should be understood that the invention is not limited to instances in which only the partly ionized specie is to be recovered. The invention is a separation process. This means that the un-ionized specie or species may be recovered as the primary output of the process. It should also be understood that the invention is applicable to separating an element and chemical compound from each other if that is the manner in which the input compound dissociates and there is partial ionization of the element.

The principal advantage of the invented process and apparatus is in separating certain metals from the more electronegative elements, oxygen in particular, but also sulphur and silicon. These elements do not ionize appreciably at the temperatures where significant ionization of the metals takes place.

The most common and economical process in current use for a wide variety of metals is to separate the metal element from its ore by chemical treatments yielding usually an oxide, and then reducing the oxide with carbon. The plasma reduction process which forms this invention takes the place of reducing the oxide with carbon since complete separation from other metallic elements is not generally possible by this invention.

Certain other elements, such as the metals found in the III and IV columns of the periodic table tend to form stable carbides so that reduction to purer metals by carbon is not possible. Examples are aluminum (III), titanium (IV) and zirconium (IV).

Separation of an aluminum from its oxides is treated in detail herein. Aluminum silicate is a more widely available source of aluminum ore than $Al_2O_3$. It is normally found in the form of clay. In aluminum silicate at 5,000°K and one atmosphere of pressure aluminum ions are more than one thousand times as abundant as silicon ions. Accordingly, the present invention provides a means whereby abundant aluminum silicate clays may become a source of fairly pure aluminum metal whereas they had not been so in the past.

Titanium is commonly prepared by converting it to titanium tetrachloride and then purifying the tetrachloride by fractional distillation. The purified tetrachloride is reduced with magnesium or sodium. It is the reduction process which is the most expensive and which makes titanium a relatively expensive metal even though it is one of the most abundant metals in the earth's crust.

The present invention has the advantage of being able to reduce titanium tetrachloride without the use of magnesium or sodium residues. Use of the present invention for the reduction of titanium oxide is feasible although difficult because TiO is very stable.

Zirconium is manufactured by essentially the same process as titanium. Pure zirconium tetrachloride is prepared and then reduced. The present invention can be used to reduce zirconium tetrachloride.

As previously stated, the present invention takes advantage of the concept that certain metal elements are at least partly ionized at temperatures where there is no significant ionization of the more electronegative elements such as oxygen, sulphur and silicon which combine to make up their ores. This provides a means whereby the ionized metals can be separated from their compounds. Thus — Aluminum from $Al_2O_3$; Aluminum from $Al_2SiO_5$; Iron from $Fe_2O_3$; Tin from $SnO_2$; Copper from CuO; Nickel from NiO; or Chromium from $Cr_2O_3$.

At temperatures high enough for alumina, by way of example, to be completely dissociated and the aluminum partly ionized in a gas, the negative charge carriers are electrons rather than ions. A simple gaseous electrolytic cell cannot be used for separation. For each positive aluminum ion that would be collected at the cathode about 50,000 electrons would reach the anode. (In the conventional liquid electrolytic cell only about one negative ion is collected for each useful positive ion.) This creates a difficult separation problem. If the electrons are prevented from flowing, a space charge will build up to such an extent that the ionic current will be drawn across a high voltage. This more than offsets the energy advantage gained in removing the cryolite through which the ions had to be forced.

In a plasma, any current $\vec{I}$ flowing in a region having a magnetic field $\vec{B}$ experiences a force $\vec{I} \times \vec{B}$ at right angles to $\vec{I}$. So the electrons are forced in a new direction by their current. If the electric current is prevented from flowing in this direction, the electrons will begin to pile up and the space charge voltage will pull the ions toward them. Then they will both move in the $\vec{I} \times \vec{B}$ direction with the speed proportional to the large electron current and inversely proportional to the mobility of the ions and the hot gas.

This then raises the question of how to provide the current $\vec{I}$ in the first instance. One possibility is to use electrodes as in the conventional electrolytic cell. The problem with electrodes is that of joule heating as a source of inefficiency as well as electrode wear both in the electrode and in the connecting wires. In the present invention this is avoided because the ions are moving in the same $\vec{I} \times \vec{B}$ direction as the electrons so that there need be no current through surfaces and no corresponding joule heating and wear.

There are two ways of creating the current $\vec{I}$ without electrodes. One is to alternate a magnetic field through a fixed plasma. The other is to flow the plasma gas through the magnetic field. In either case, the gas sees an effective electric field whose lines of force make closed loops. Thus, if walls do not intersect these lines, the current produced by this electric field never has to leave the gas. The disadvantage of using a varying magnetic field is that stray currents may be induced in the walls of the structure containing the plasma. Therefore, a more acceptable procedure is to flow the gas at a high velocity through a fixed (or relatively fixed) magnetic field.

The direction of the magnetic field is significant. A parallel magnetic field can be used to separate the ions from neutral particles since charged particles spiral around magnetic field lines, whereas neutral particles are unaffected. This works very efficiently but very slowly because low pressures are required to avoid deleterious collisions. However, a magnetic field at an angle to the flow generates a separating force that operates well at high plasma pressures and large flow velocities so that large throughputs are possible.

The separation concept uses both perpendicular and parallel magnetic field components. A magnetic field is oriented at an angle $\beta$ relative to the plasma flow velocity $\vec{v}$. Accordingly, the magnetic field has a perpendicular component $\vec{B}_{\perp}$ and a parallel component $\vec{B}_{\parallel}$ relative to the plasma flow velocity $\vec{v}$. The interaction of $\vec{B}_{\perp}$ with $\vec{v}$ produces a current density $\vec{J}$. The interaction of $\vec{J}$ and $\vec{B}_{\parallel}$ produces a separating force $\vec{F}$ which is perpendicular to $\vec{v}$. The current is allowed to close upon itself so that space charges do not build up. For this reason, a structure having axial symmetry is provided. The separating force is either inward or outward and depends upon the direction of the magnetic field.

Although the present invention is described primarily in respect to separating metals from their compounds, it should be understood that the principles apply equally to separating any element which is a constituent part of a particular type of matter where one element can be at least partly ionized in a gaseous phase without substantially ionizing the other element or elements which comprise the matter. The invention is also applicable to separating a non-ionized species from two or more ionized species of the compound. That partially ionized element together with the neutral particles of the same element can be separated using the principles of the separator described herein. In particular, the matter is heated to a gaseous phase wherein the one element (specie) is at least partly ionized. The gas is then passed at an angle through a magnetic field and at a high velocity. Both the ionized and neutral particles of the partly ionized element are forced toward a collection point as hereinafter described.

A principle advantage of the invention is that separation is achieved even though ionization is only partial. Indeed, production rate is independent of percent ionization above a few tenths of a percent. This means less energy is required to effect the separation. No more energy need be put in than is required to dissociate and partly ionize one specie element at about 1–2%.

Another advantage of the invention is that separation takes place at moderate pressures, such as .5 atmospheres, rather than low pressures such as <0.001 Atm. This permits high throughput rates making the process economically feasible for the amount of energy put in.

II. THE DRAWINGS

For the purpose of illustrating the invention, there is shown in the drawings a form which is presently preferred; it being understood, however, that this invention is not limited to the precise arrangements and instrumentalities shown.

FIG. 1 is a schematic diagram of the invented process.

Figure 11:
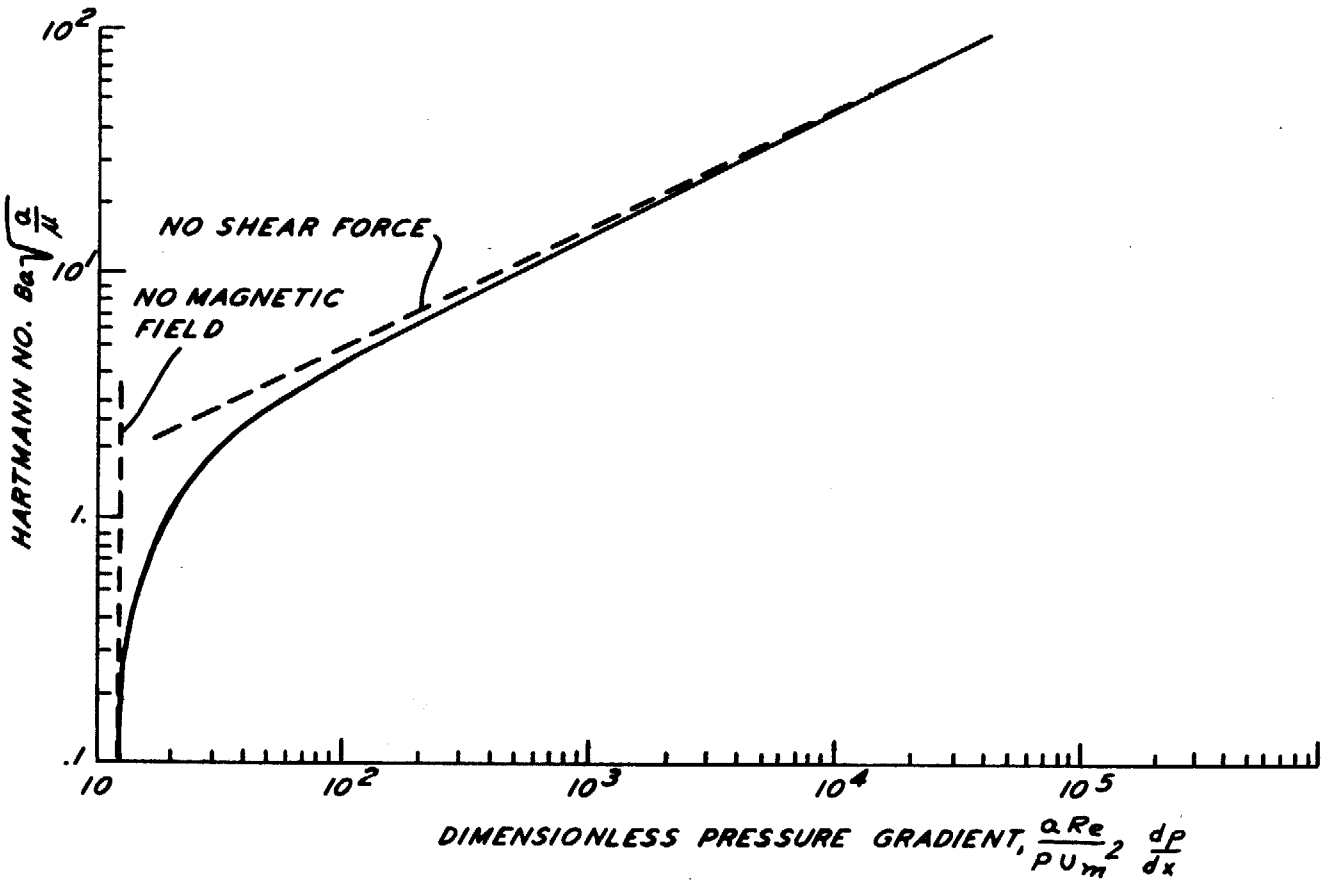

FIG. 11 plots a Hartmann number against the dimensionless pressure gradient.

FIG. 12 is a graph schematically illustrating the interrelationship of current density, magnetic field and force density.

Figure 13:
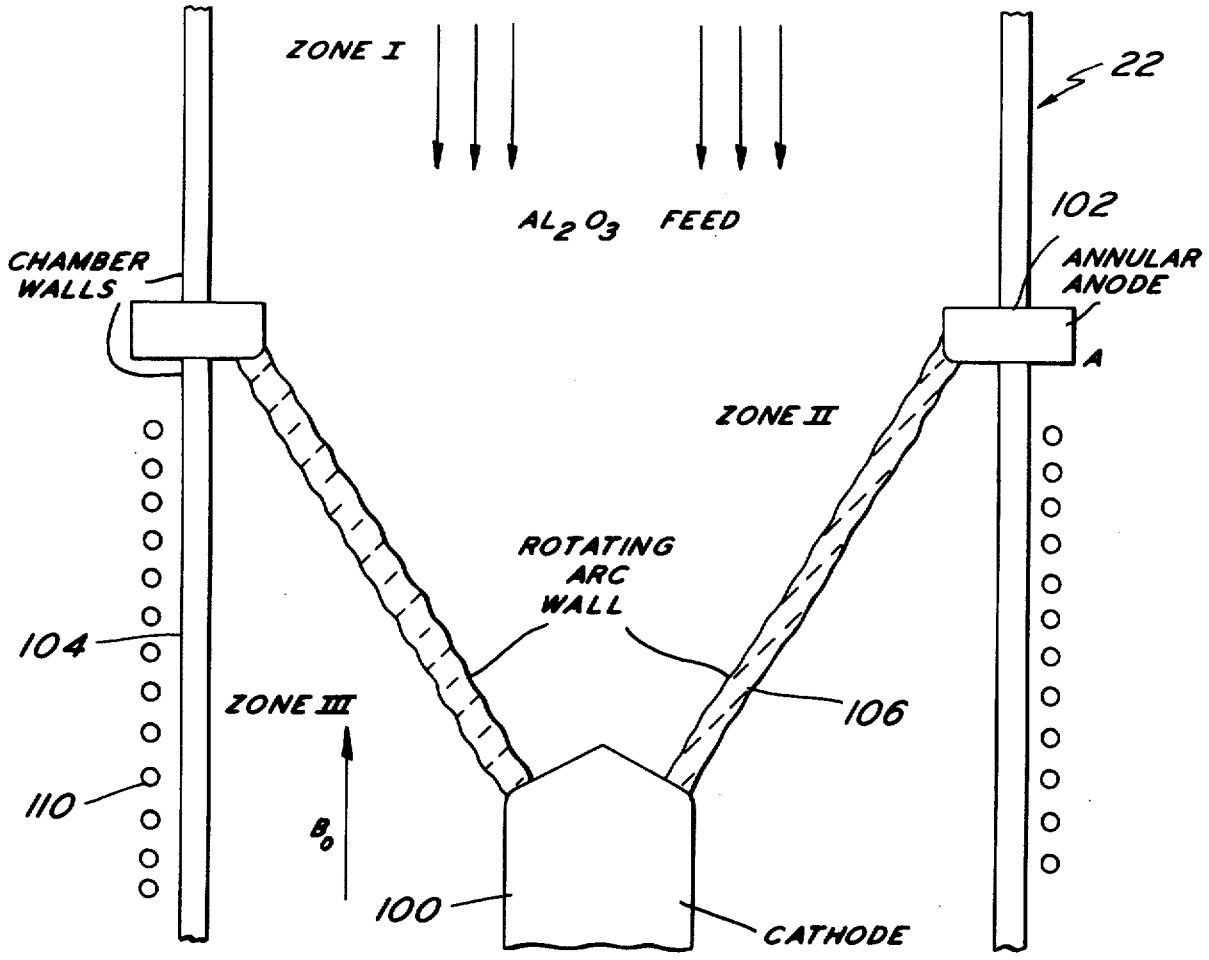

FIG. 13 is a sectional view of an arc heater.

Figure 14:
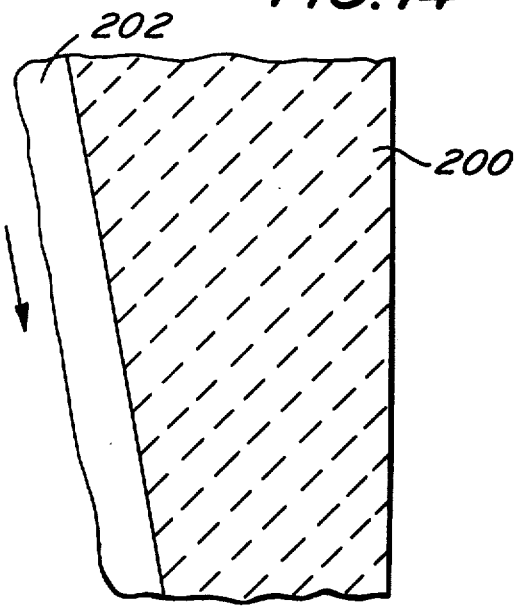

FIG. 14 is a partial sectional view of a wall.

Figure 15:
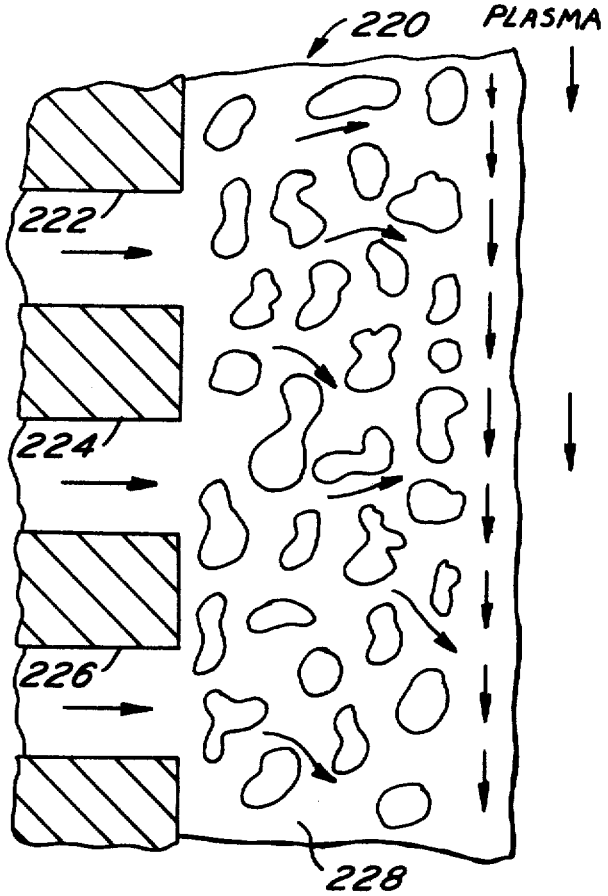

FIG. 15 is a partial sectional view of another embodiment of a wall.

Figure 16:
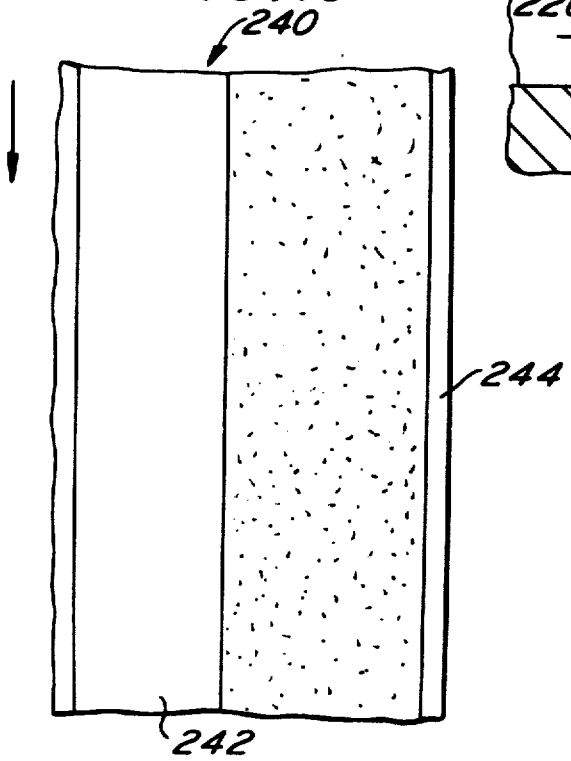

FIG. 16 is a partial sectional view of yet another embodiment of a wall.

III. THE SEPARATING PROCESS AND THE SEPARATOR

A. Introduction

It has been pointed out that scientists have for years considered it desirable to provide processes for separating gaseous atoms from each other. It has also been known that ionization of the gaseous atoms at high temperatures suggest at least the concept that separation may be possible.[5] Indeed, separation has been achieved with certain limitations as pointed out in respect to processes which rely upon mass differences and recombination rates.

Varney U.S. Pat. No. 1,954,900 is an interesting early example of a process for reducing metallic ores by separating ionized vapors. A metallic compound is heated and ionized by an arc passing between two electrodes. A magnet drives the arc and the ionized gas from a reduction chamber to a condensing chamber or receptacle. Separation is accomplished by relying upon velocity, mass and gravity. Thus, the higher velocity particles fall by gravity into a different portion of the wall of the horizontally positioned collecting receptacle than do the slower velocity particles.

The present invention separates a selected specie element from the remaining elements in the matter being processed using principles of magnetofluid dynamics. Before describing the invention in detail it may be more helpful to first briefly describe the apparatus and process in its entirety and then refer in detail to the basic sections thereof.

The principal aspects of the process are heating the matter from which a specie element is to be separated until the matter dissociates into a gaseous state and is at a temperature at which such specie element is partly ionized. At such temperature the remaining elements have no significant ionization and hence may be regarded as neutral. The gas and plasma is passed at a high velocity through a magnetic field having both parallel and perpendicular components relative to the direction of flow. The process is schematically illustrated in FIG. 1. The matter, including the specie element to be separated, is fed into the heater, vaporizer and ionizer 10 driven by an appropriate source of power. The matter then passes from the heater, vaporizer and ionizer 10 to the separator 12 where the partly ionized specie element is separated from the other elements of the matter. The separator 12 is energized to the extent necessary by an appropriate source of power which in the described embodiment is electrical and mechanical power. The specie element, as shown, is taken from the separator while by-products consisting of the remaining matter are appropriately processed in by-product and recycling devices 14. As described hereinafter, it is desirable to recycle some of the by-products to assist, by way of heat transfer, in the heating and ionization process. Excess heat could also be used to drive appropriate thermal engines.

It should be understood that the term "by-product" is used merely for convenience and to distinguish that matter from the separated specie element. Such term is not meant to imply any distinction as to the nature or ultimate use of the by-product made up of the neutral species.

Heaters, vaporizers and ionizers for accomplishing the heating and partial ionization process are described infra. Separators and the basic separating process are described in this section. The by-product and recycling processes are not described herein except that insofar as recycling of oxygen for heat exchange and calcining are set forth hereinafter. In yet another section, processes and apparatus for containing the hot gases are described.

B. The Apparatus

Figure 2:
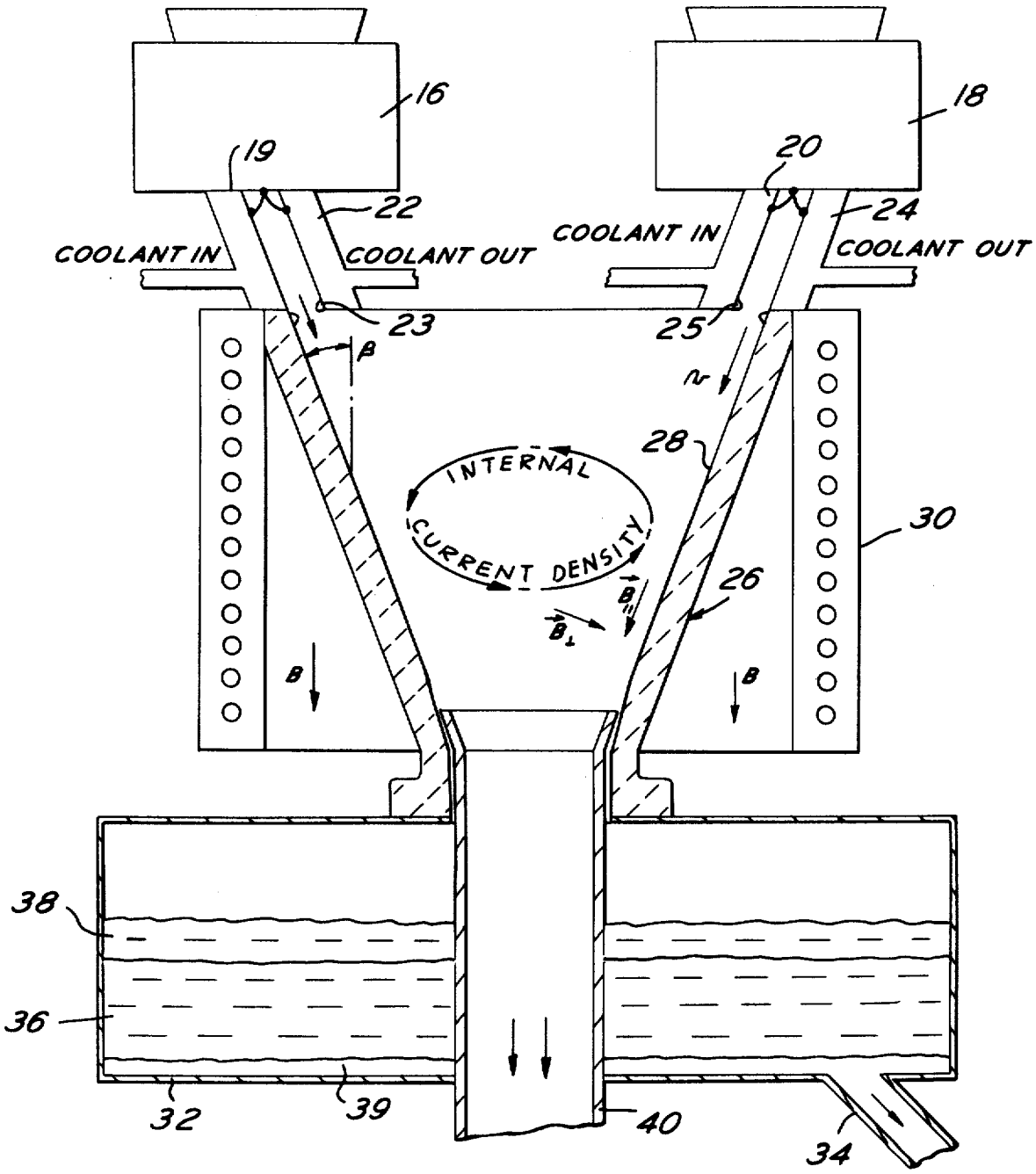
FIG. 2 is a sectional view of the apparatus.

Referring to FIG. 2, there is shown an apparatus for partly ionizing one element in a compound and then separating the partly ionized element from the remaining elements of the compound. Aluminum is specifically referred to hereinafter. However, it should be understood that the principles apply generally to compounds where only one specie is ionized. As shown, the apparatus includes means 16 and 18 for feeding the compound into the vaporizers 19 and 20 described hereafter. The specific manner in which the compound 20 is fed into the vaporizers is not part of the present invention. Hence, it need not be described in detail.

The vaporized compound passes from the vaporizers 19 and 20 into the arc heaters 22 and 24, provided with an appropriate cooling means. This compound is further heated until it dissociates into a gas consisting of the dissociated constituent elements. Although only two arc heaters 22 and 24 are shown, it should be understood that additional heaters may be positioned around the periphery of the top of the separator 26 for feeding the desired amount of gaseous material into the apparatus.

The vaporized and dissociated compound is further heated to ionization temperature by arcs 23 and 25 positioned within the magnetic field B. If desired ionization can be accomplished using a radio frequency field rather than the arcs 23 and 25. Ionization must take place within the magnetic field. Otherwise, the ionized particles will not enter into it.

The separator 26 is positioned immediately below the arc heaters 22 and 24 and, as shown, comprises a structure having a generally frusto-conical interior wall 28. The gas pressure generated in the arc heaters 22 and 24 feed the plasma into the separator 26 at an angle and velocity generally parallel to the wall 28 such that gaseous plasma flows with the appropriate velocity along the wall and at an angle $\beta$ to the magnetic field B generated by the magnetic coil 30. Magnetic coil 30 is of the super conductive type (cryogenic) so as to be capable of generating a magnetic field of the appropriate field strength as hereinafter more specifically described.

The wall structure 28 of the separator 26 may be made of porous material (preferably the same as the ore) through which is forced liquid, or liquid metal, or a combination of them (e.g., liquid aluminum, liquid alumina, or a combination of liquid aluminum and liquid alumina) for transpiration cooling as more particularly described hereinafter in Section V. The wall could also be alumina which is allowed to vaporize and is replaced from time to time or continuously.

The separated metal condenses on the lower portion of the wall structure 28 and flows down into the annular receptacle 32 where it is collected, and from which it may be tapped off through the outlet 34. A slag 38 is shown floating above the metal 36 within the receptacle 32. Dense slag 39 is shown at the bottom of receptacle 32.

The outlet 40 is provided for exhausting and recycling by-product gases and other matter from which the metal has been separated. Such by-product gases will consist primarily of oxygen as, by way of example, in the case of separating aluminum from $Al_2O_3$ and iron from $Fe_2O_3$.

The structure shown in FIG. 2 can be modified such that plasma and gas flow along the outer surface of a cone. The separation process works equally well and a central ionizer at the apex of the cone could be used.

Figure 3:
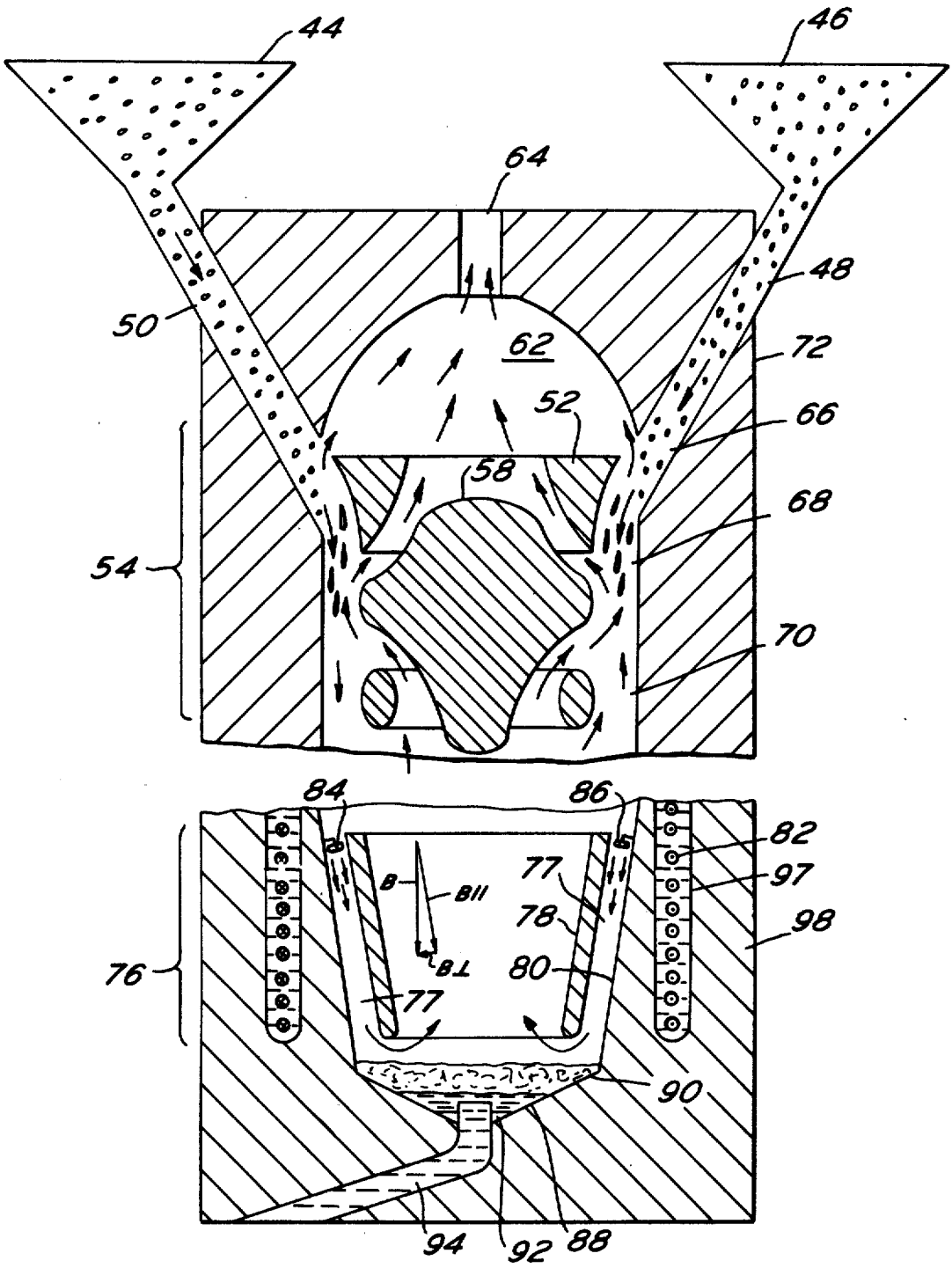
FIG. 3 is a sectional view of another embodiment of the apparatus.

Referring now to FIG. 3, there is illustrated yet another apparatus embodying the principles of the invention. As shown, a compound, such as alumina, is fed by the feed means 44 and 46 into the channels 48 and 50. The means for feeding the compound into the channels 48 and 50 does not form a part of the present invention and hence is not described in detail. Additional feed means, as desired, may be provided.

The compound, moving at a high velocity, is deflected by deflector 52 into the melting section 54 where it is melted and heated to a temperature close to the boiling point of the compound. The compound is heated to this condition by a heat exchange process with oxygen fed back from the separator after the aluminum has been removed from the gas. As shown, the fed back oxygen impinges upon the oxygen deflector 58 so that it flows over and past the particles to heat and melt the same. The deflectors 52 and 58 also serve to guide the oxygen into chamber 62 from which it is exhausted through port 64 to a heat engine, calcining plant, or the like.

The vaporization of the compound is illustrated in FIG. 3 by showing it in particle form in the region 66. In the region 68 it is illustrated in its liquid form by depicting droplets.

The liquified compound moves at a high velocity into the separating section 76. At the top of this section it is vaporized and ionized by plasma torches 84 and 86.

As shown in FIG. 3, the annular channel through which the gaseous vapors are directed is conical, as defined by the annular wall 78 and the outer wall 80. This causes the gaseous vapor to flow at an angle to the magnetic field B generated by the super conductive magnetic coil 82.

The liquified compound is heated so as to provide vaporization and the requisite partial ionization of the selected element to be separated from the other elements by means of plasma jets positioned at the head of the conical channel defined by the walls 78 and 80. The plasma jets are generated by plasma torches 84 and 86 driven by an appropriate source of electrical power. Such torches may be three phase alternating current torches which can be operated at 90% thermal efficiency to produce gases at temperatures of 5,400°K–7,000°K. If desired, a rotating arc process for vaporizating and partially ionizing may augment the plasma torches. Such rotating arc is illustrated in FIG. 13 and described in Section IV, infra.

The magnetic coil 82 is preferably a solenoid which surrounds the entire conical annular channel 77 and generates a magnetic field B parallel to the axis of the apparatus. The length of the coil 82 is such that ionization takes place within the magnetic field.

As explained in more detail hereinafter, the combined interaction of the perpendicular magnetic field component $B_{\perp}$ and the parallel magnetic field component $B_{\parallel}$ acts upon the ionized element to drive it toward one of the walls 78 or 80. Since the magnetic field B is mostly in the direction of flow of the ionized element and such flow is angled inwardly toward the axis of the apparatus, the partially ionized element is driven and therefore diffuses toward the outer wall 80 and flows downward to be collected in the receptacle 88. A slag 90 is shown floating on the top surface of the liquid metal 92. The liquid metal may be tapped out of the receptacle 88 via conduit 94.

The remaining elements of the gaseous vapors, such as oxygen in the case of separating aluminum from alumina, returns through the center of the annular wall 78 as indicated by the arrows. From there it is conducted to the deflector 58 for a heat exchange with the incoming metal ore as described previously.

The walls of the apparatus are appropriately cooled either by convective cooling or transpiration cooling as described in more detail in Section V. Ablative walls may also be used. So as not to unduly complicate the description of the invention, such cooling means are not shown in FIG. 3. However, it should be indicated that the walls are preferably made of the same material as the matter being reduced. By way of example but not limitation, the walls may be made of sintered alumina when separating aluminum.

The recirculating oxygen or other gaseous matter will also revaporize some of the slag 90 and conduct it through the apparatus where it will again become entrained with the incoming particles and be recycled for further separation of the selected element.

C. Detailed Description Of The Separation Process

Figure 4:
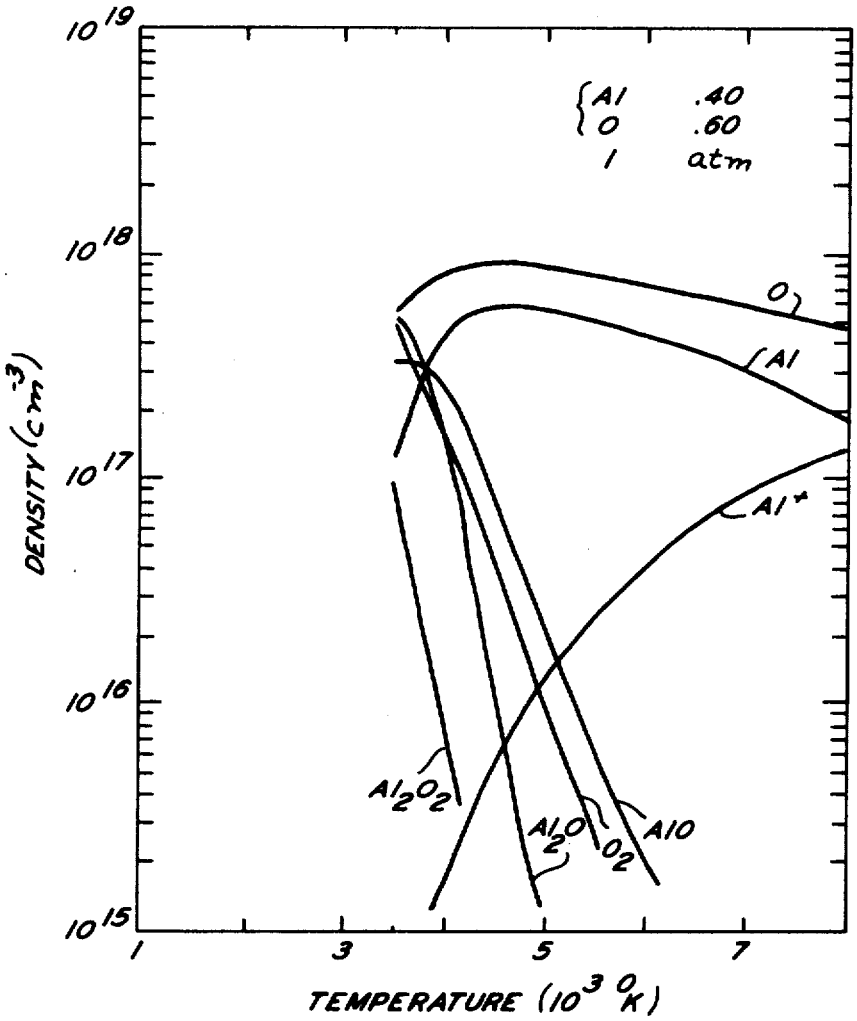
FIG. 4 is a graph showing the equilibrium composition of $Al_2O_3$ at 1 atmosphere.
Figure 5:
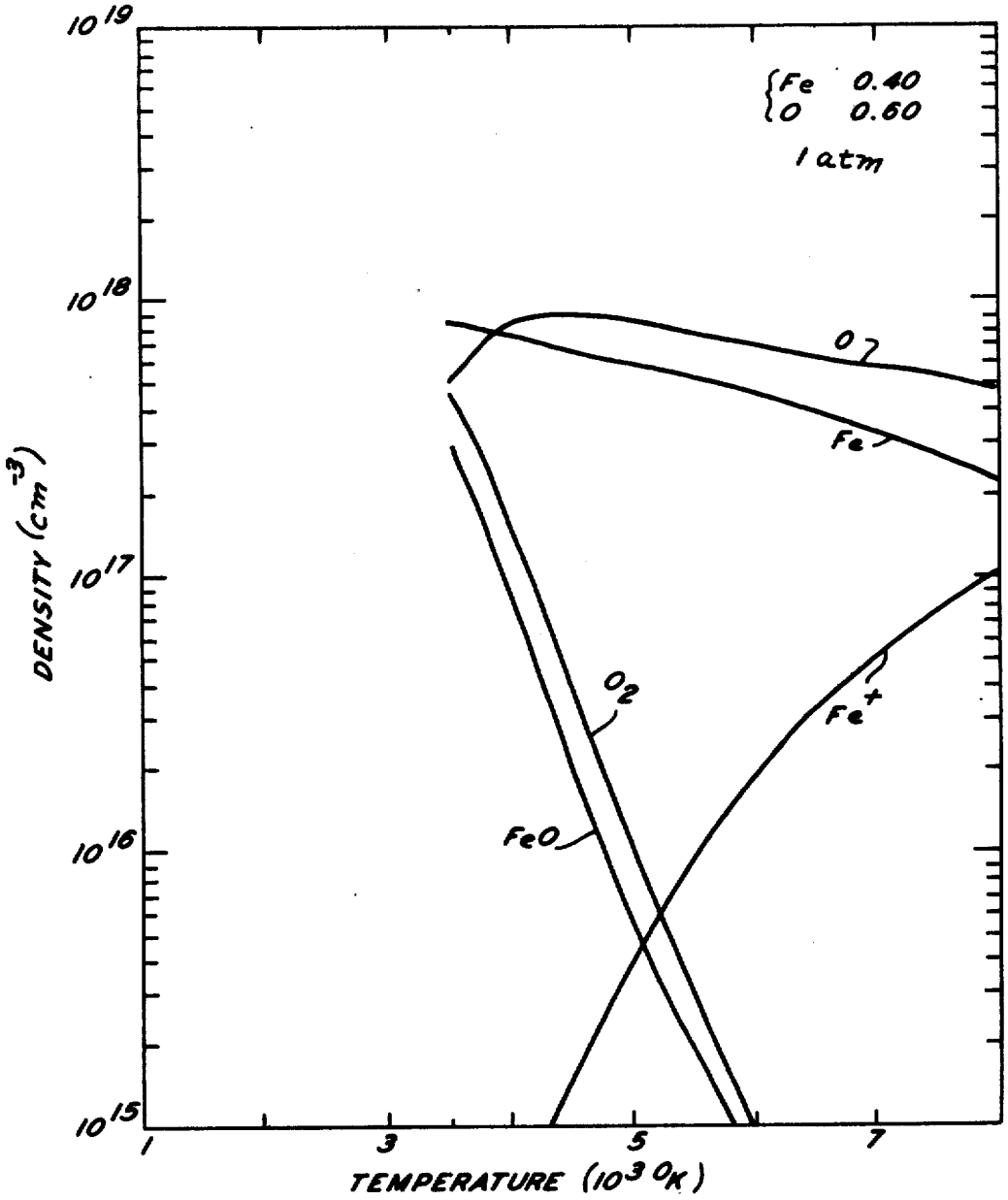
FIG. 5 is a graph showing the equilibrium composition of $Fe_2O_3$ at 1 atmosphere.
Figure 6:
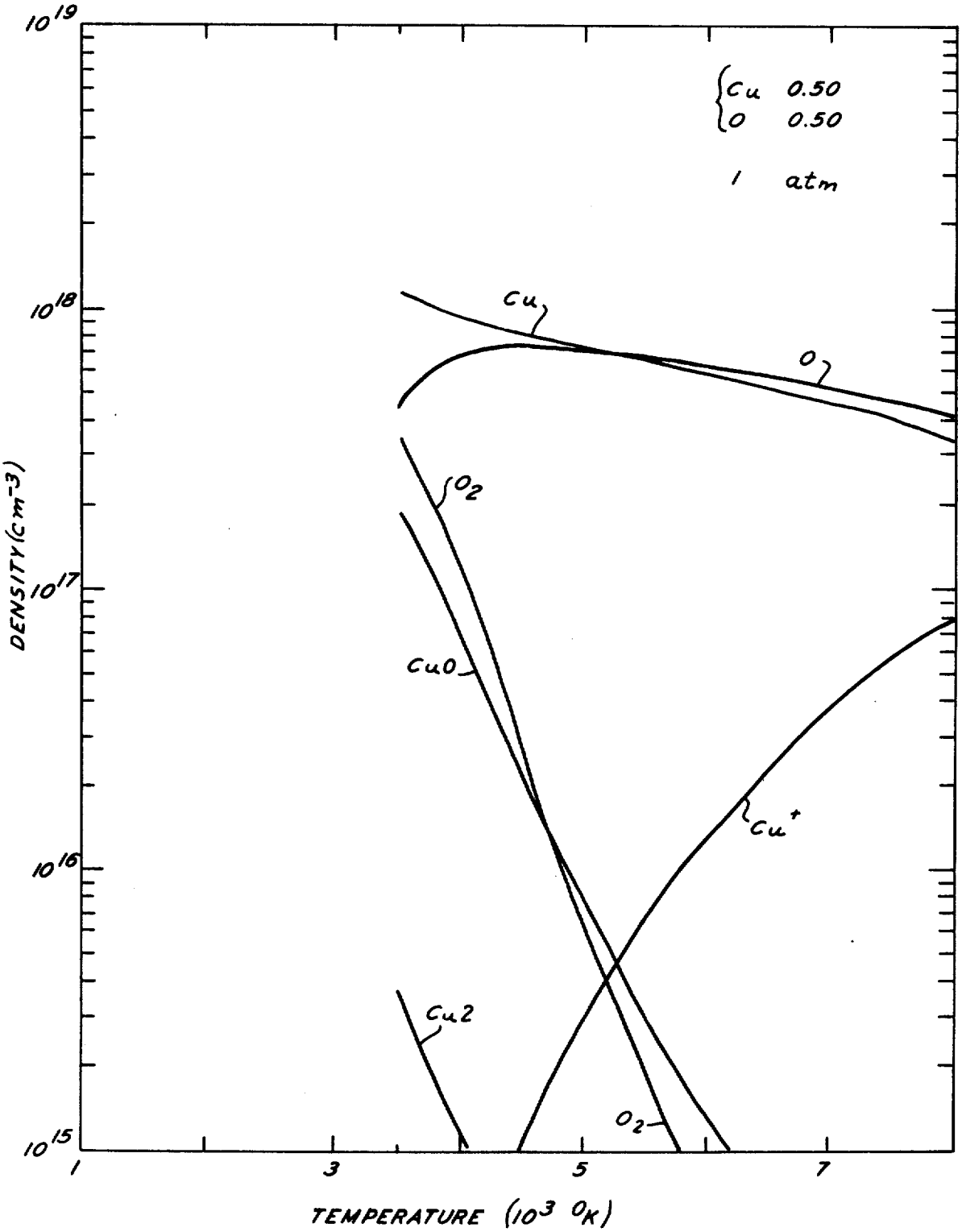
FIG. 6 is a graph showing the equilibrium composition of CuO at 1 atmosphere.
Figure 7:
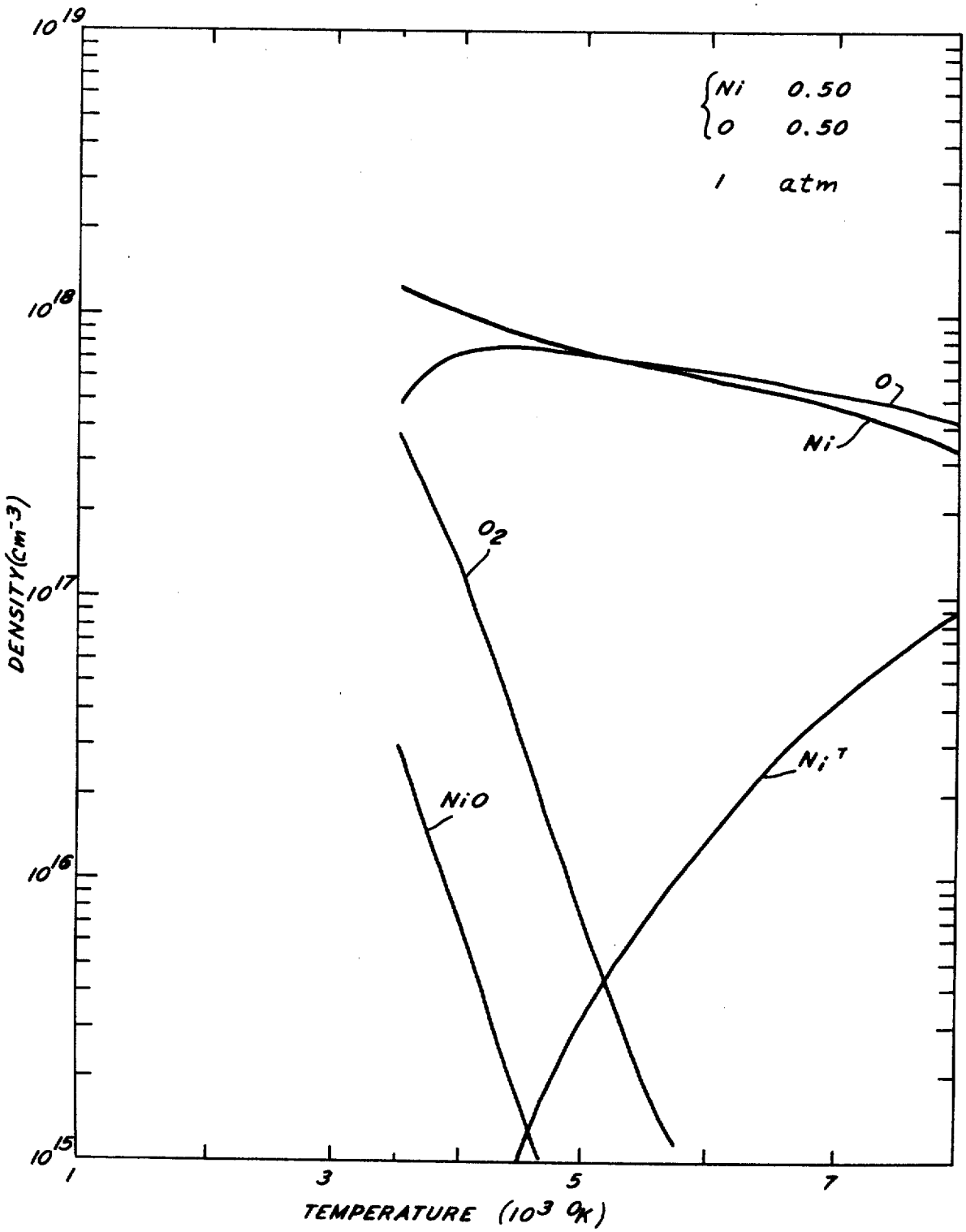
FIG. 7 is a graph showing the equilibrium composition of NiO at 1 atmosphere.
Figure 8:
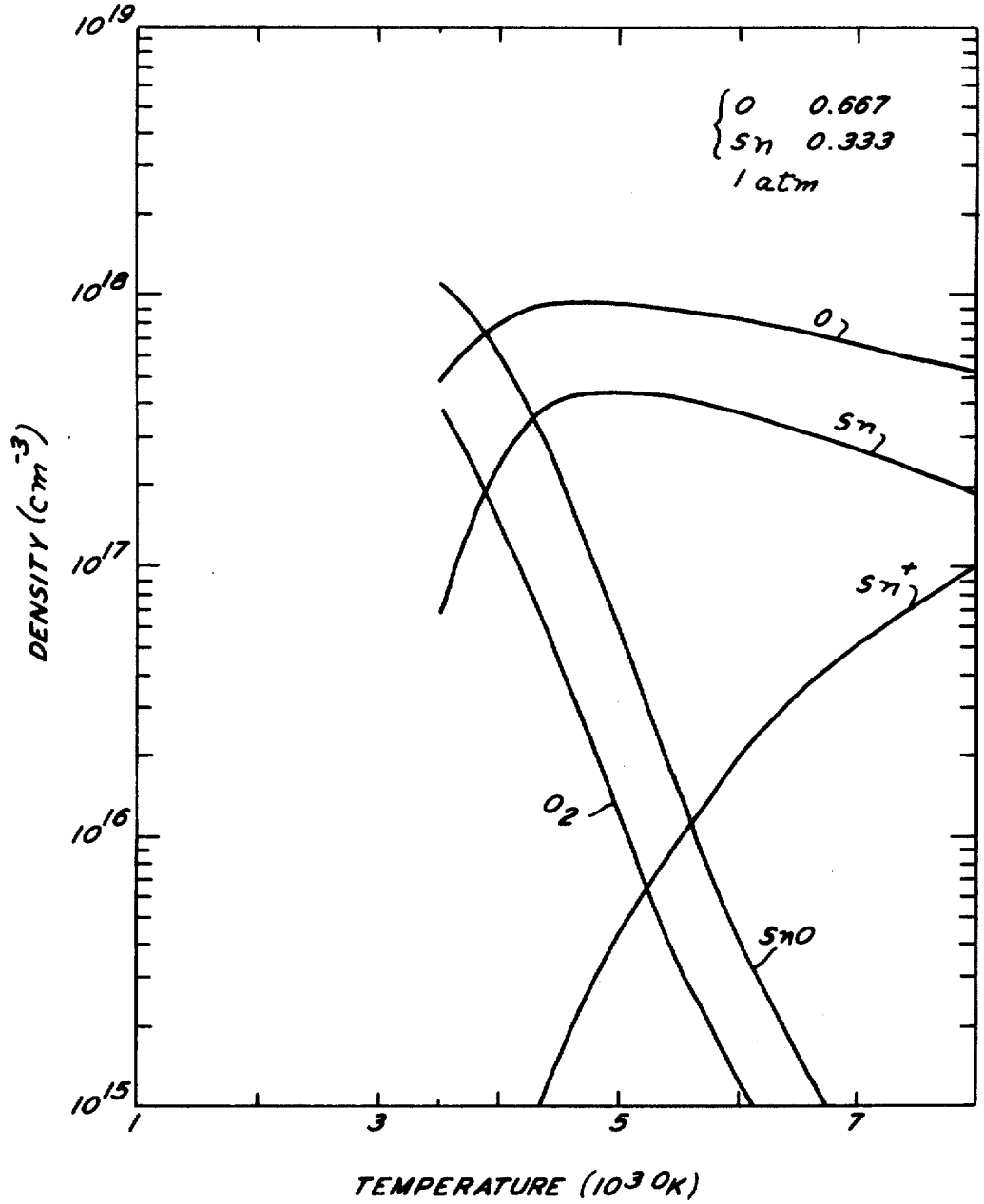
FIG. 8 is a graph showing the equilibrium composition of $SnO_2$ at 1 atmosphere.
Figure 9:
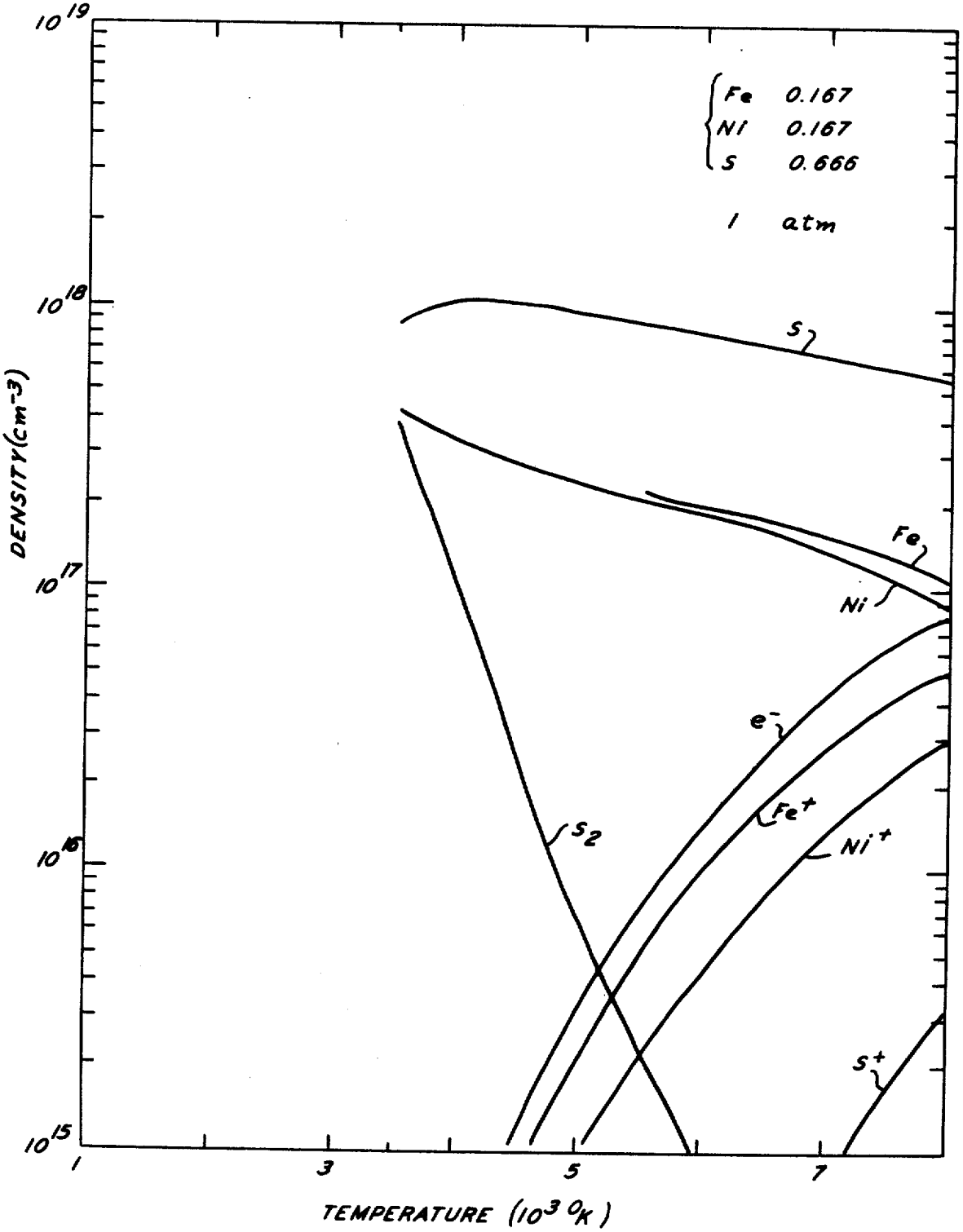
FIG. 9 is a graph showing the equilibrium composition of $FeNiS_4$ at 1 atmosphere.
Figure 10:
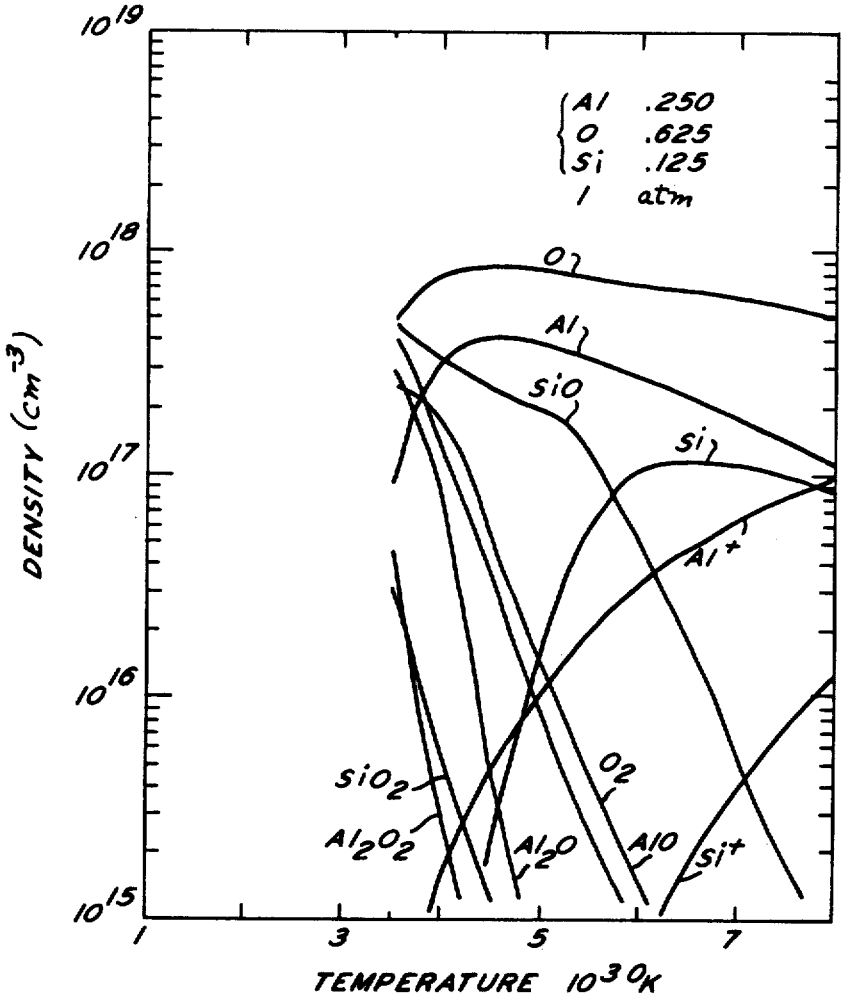
FIG. 10 is a graph showing the equilibrium composition of $Al_2SiO_5$ at 1 atmosphere.

In this section, it is assumed that the gas which contains the elements to be separated has already been heated to a temperature where it is dissociated into its various atomic constituents and one element is partly ionized. This is graphically illustrated in FIGS. 4, 5, 6, 7, 8, 9, and 10 in which the equilibrium composition of various compounds is plotted. FIG. 4 is the equilibrium composition of $Al_2O_3$ at one atmosphere. Note that 2% ionization occurs at approximately 5,000°K in FIG. 4. FIG. 5 is the equilibrium composition of $Fe_2O_3$ at one atmosphere. FIG. 6 is the equilibrium composition of CuO at one atmosphere. FIG. 7 is the equilibrium composition of NiO at one atmosphere. FIG. 8 is the equilibrium composition of SnO at one atmosphere. FIG. 9 is the equilibrium composition of $FeS_2.NiS_2$ at one atmosphere. FIG. 10 is the equilibrium composition $Al_2SiO_5$ at one atmosphere. The temperature at which between 1–10% ionization takes place is easily read from these graphs.

Each of these graphs shows that there exists significant ionization of one element in the compound between 5,000°–6,000°K. This inequality may be found in other compounds of which the foregoing graphs are exemplary. It should be indicated that the curves illustrated in FIG. 4–10 are valid only for gases, not solids. It should also be indicated that these graphs are shown as being examplary of ionization of one element in a compound. They are not intended to limit the applicability of the process. For example, the process is also useful for sulphide ores. Further still, the sought after element need not be the partly ionized element. The process is one of separation. Hence the desired element could be the one that is not ionized. Moreover, the desired "element" could even be a compound.

The process is applicable to raw are as mined. The only treatment necessary is grinding and drying. The only exception to this would be the unexpected situation where an ore includes significant quantities of an element having an ionization potential at or lower than the ionization potential of the element sought. In that instance further separation by flotation or chemical treatment to remove the unwanted element may be necessary.

The invention is based upon the fact that the selected specie element, such as aluminum ions (Al+), is the major ionic species in a gaseous mixture between 5,000°K and 10,000°K. Since the cross section of charge exchange between an atom and an ion of the same element is very large, each selected specie element has a high probability of being ionized within a short period of time. By applying a magnetic field to the mixture of gas and plasma, the partially ionized flow of the selected specie element (e.g., Al with Al+) is affected by the magnetic field.

A chamber is provided in which a continuously generated ring of mixed plasma (partly ionized specie) and gas is forced to flow along the surface of a cone in an axial-magnetic field. By Lenz's law a conductor resists the change in the total magnetic flux which it encompasses. Consequently, the conducting plasma experiences a force which the non-conducting gas does not directly experience. This force produces a separation of the plasma and gas. For purposes of illustration, not limitation, specific reference is made herein to the separation of aluminum from alumina. However, the general application of the concept to other forms of matter is readily apparent from the equations and examples set out infra.

The term "plasma" is used throughout this specification. As used herein, it is intended to mean that portion of an ionized gas or vapor of such extent that within it static charges are statistically screened by charges of opposite sign and of small extent compared to the extent of the gas.

FIG. 2 shows the separator 26 with a conical wall 28. It is fed with an input of aluminum and oxygen in which at least part of the aluminum is ionized (Al+). The coil 30 provides a uniform magnetic field $\vec{B}$ having the direction indicated by the arrow. The flow of the plasma and gas is parallel to the wall 28 of the separator 26 and hence at an angle $\beta$ to the magnetic field $\vec{B}$.

In the separator 26, the hot gases (consisting of aluminum ions, electrons, neutral aluminum atoms and neutral oxygen atoms) flow along the conical wall gas and In FIG. 3, the flow channel 77 is defined by walls 78 and 80. In the embodiment shown in FIG. 2, the width of the flow channel is defined by the inlet from the arc heater 22 and 24. The gas is moving at a velocity $\vec{v}$ less than the speed of sound and at an angle $\beta$ to the magnetic field B. The magnetic field is produced by the coil 30 (a super conducting solenoid in a liquid helium bath) and is nearly uniform over the cross section of the separator 26. As the hot gas plasma move along the chamber wall, a large current carried primarily by the electrons is produced. The electrons exist by virtue of having been pulled off of the aluminum atoms.

The electrons flow around the axis of the separator by reason of the fact that they are being forced to move at right angles to the perpendicular component of the magnetic field $\vec{B}_\perp$ and the gas velocity. This motion produces a current density $\vec{J}$ circulating around the axis of the machine. This circulating current, which closes upon itself, in turn interacts with the parallel component of the magnetic field $B_\parallel$, producing another force on the electrons. This force density $\vec{F}$ is either radially in or out. If the plasma is travelling down a converging conical path, as shown in FIG. 2, the force is, by Lenz's law, outward. If the conical path is a diverging one, the force $\vec{F}$ would be such as to oppose that and hence would be radially inward.

In FIG. 2 the electrons are diffusing toward the wall 28 of the separator 26. As they start to move, an electric field arises due to the separation between the ions (Al+) and the electrons. This radial field pulls the ions after the electrons toward the wall surface 28 where they flow into the receptacle 32. The foregoing relationships between the magnetic field $\vec{B}$, the current density $\vec{J}$ and the force $\vec{F}$ density is shown in FIG. 12. Note that the force is everywhere outward.

The force density is $$F = \frac{v\, B_\perp \quad B_\parallel}{\eta} \qquad (1)$$

where the terms are as defined above and $\eta$ is the resistivity of the gas and plasma.

It should be recognized that there is a charge exchange between the neutral aluminum atoms and the aluminum ions. An electron may jump from an atom to a nearby aluminum ion, thus converting that ion back into an aluminum atom. The atom that just lost the electron is now an ion which now feels the pull of the electrons moving toward the wall. By averaging out this exchange between neutral aluminum atoms and aluminum ions over a given time scale, any given aluminum atom appears to have a positive charge which is less than the electron's charge. Thus, all of the aluminum atoms can be regarded as "partial aluminum ions". The electric field created by the electrons is large enough to pull all of the aluminum atoms.

Stated otherwise, the resonant charge exchange is important to the fulfillment of the process. Typically, the resonant charge transfer cross section is approximately $10^{-14}$cm$^2$. This means that a given atom changes its ionization state approximately $10^7$ times per second for a temperature of several thousand degrees K and a pressure of the order of one atmosphere. Accordingly, an aluminum atom can only move a few tens of microns before changing its ionization state. This fact means that a very small percentage of ionization is capable of moving the whole body of aluminum by electric forces.

It should be indicated that equation 1 states the condition at any one position of the partly ionized gas mixture within the magnetic field. Thus, the velocity $\vec{v}$ may vary along the direction of flow of the gas. Indeed, the velocity of the gas will increase as it flows from the entrance to the exit of the separator 26. Such velocity is, preferably less than the speed of sound. It should be understood, however, that the invention is equally applicable at supersonic velocities provided that cooling and heat exchange problems existing at such velocities can be resolved. Still further, the angle $\beta$ in the embodiment shown in FIGS. 2 and 3 is fixed. However, the wall of the separation device may, if desired, be contoured to thereby vary the separating force, if desired.

As shown below, the electric force on each ion is nearly inversely proportional to the ionization of the ionized specie such as aluminum. Thus the total force per unit volume (force per ion times the number of ions per unit volume) as given by equation (1) is nearly independent of the percentage ionization. This can be carried only so far, however before $\eta$ increases much. The limit is around few tenths percent ionization of the aluminum. This is an advantageous situation because partial ionization of about 1% is the amount of ionization that occurs when alumina for example is heated to a high enough temperature to thoroughly dissociate the molecule into its constituent atoms. What this means is that no more energy has to be put into the process of heating than would be required to fully dissociate the alumina. Stated otherwise, very little more energy than is required to dissociate the compound need be used to partially ionize the species to be separated, and little more than that to accomplish separation. Large quantities of energy for full or substantial ionization of the selected species is not required.

The governing equations for calculating the performance and design requirements of the process consist of the fluid mechanical conservation equations for mass, momentum and energy and the electromagnetic field equations. Derivations of the fluid mechanical equations from rigorous kinetic theory are well known and may be found in standard reference texts on the subject.

1. Magnetofluid Dynamics

The purpose of this section is to derive an equation for the flux density of aluminum so that the throughput of the machine may be calculated.

The time independent momentum balance equation for partially ionized aluminum ($\alpha$ is the fractional ionization) is (neglecting the convective derivative as small):

$$n_A \alpha\, e(\vec{\nabla}\phi - \vec{V}_A \times \vec{B}) + \kappa\vec{\nabla}(n_A T) + n_A m_A\, \nu_A(\vec{v}_A - \vec{v}_o) = 0 \qquad (2)$$

where $n_A$ is the number density of aluminum atoms and ions $e$ magnitude of electronic charge $v_A$ drift velocity of aluminum atoms and ions $\vec{B}$ is the magnetic field $\kappa$ is Boltzman's constant $T$ is the temperature of the gas and plasma $m_A$ is the mass of an aluminum atom or ion $v_o$ is the flow velocity of the oxygen $\phi$ is an electric potential which will arise and $\nu_A$ is the collision frequency for momentum transfer from an aluminum atom to oxygen atoms.

Because of the small mass of an electron, $\nu_A$ is taken as much greater than the momentum transfer collision frequency between an aluminum atom and electrons.

From Equation (2) the mean velocity of aluminum atoms can be derived in a straightforward manner taking the $x$-axis along $\vec{B}$. By symmetry $\delta_z\phi = \delta_z(nT) = 0$. Then the angle between $\vec{B}$ and $\vec{v_o}$ is $$\beta << 1 \tag{3}$$

and $$v_{Ax} = v_o - \frac{\alpha e\delta_x\phi + \frac{k}{n_A}\delta_x(n_AT)}{m_A\nu_A} \tag{4}$$

$$v_{Ay} = -\beta v_o - \frac{\alpha e(\delta_y\phi - v_{Az}B) + \frac{k}{n_A}\delta_y(n_AT)}{m_A\nu_A} \tag{5}$$

Once defined in this disclosure, terms are not redefined.

$$v_{Az} = -\frac{\alpha e v_{Ay}B}{m_A\nu_A} \tag{6}$$

where the subscripts $x$ $y$ and $z$ denote $x$ $y$ and $z$ components.

The momentum balance equation for electrons is $$n_e e(\vec{\nabla}\phi - \vec{v}_e B) - k\vec{\nabla}(n_eT) - n_e m_e \nu_e(\vec{v}_e - \vec{v}_A) = 0 \tag{7}$$

where $n_e$ is the number density of electrons $v_e$ is the drift velocity of the electrons $m_e$ is the electron mass $\nu_e$ is the collision frequency for momentum transfer from an electron to aluminum.

Because of the long range of the force between an electron and aluminum ions, where $\alpha \geq 0.01$, $\nu_e$ is much greater than the momentum transfer collision frequency between an electron and oxygen atoms.

From Equation (7) the mean velocity of electrons can be derived in a straightforward manner:

$$v_{ex} = v_{Ax} + \frac{e\delta_x(\phi) - \frac{k}{n_e}\delta_x(n_eT)}{m_e\nu_e} \tag{8}$$

$$v_{ey} = v_{Ay} + \frac{e[\delta_y(\phi) - v_{ez}B] - \frac{k}{n_e}\delta_y(n_eT)}{m_e\nu_e} \tag{9}$$

$$v_{ez} = v_{Az} + \frac{ev_{ey}B}{m_e\nu_e} \tag{10}$$

Substituting for $\delta_y\phi$ from Eq. (9) into Eq. (5) yields $$v_{Ay} = -\beta v_o - \left\{\alpha\left[ev_{ez}B + \frac{k}{n_e}\delta_y(n_eT) + m_e\nu_e(v_{ey} - v_{Ay}) - ev_{Az}B\right] + \frac{k}{n_A}\delta_y(n_AT)\right\}[m_A\nu_A]^{-1} \tag{11}$$

The Debye length is very small compared with 1 centimeter so approximate charge neutrality will obtain:

$$n_e \approx \alpha n_A \tag{12}$$

Because the outer and inner wall, if any, are electrically isolated, little, if any, electrical current will flow normal to their surfaces, i.e. in the y-direction. Hence, $$n_e v_{ey} \approx \alpha n_A v_{Ay} \tag{13}$$

In view of Eq. (12) this becomes $$v_{ey} \approx v_{Ay} \tag{14}$$

Thus the term involving $v_{ey} - v_{Ay}$ in Eq. (11) can be eliminated. Substituting for $v_{ez}$ from Eq. (10) into Eq. (11) then yields $$v_{Ay} = -\beta v_o - \left\{\alpha\left[eB\frac{ev_{ey}B}{m_e\nu_e} + \frac{k}{n_e}\delta_y(n_eT)\right] + \frac{k}{n_A}\delta_y(n_AT)\right\}[m_A\nu_A]^{-1} \tag{15}$$

Utilizing Eq. (14) again in Eq. (15) yields $$v_{Ay} = \frac{-\beta v_o - \frac{k}{m_A\nu_A}\left[\frac{\alpha}{n_e}\delta_y(n_eT) + \frac{1}{n_A}\delta_y(n_AT)\right]}{1 + \frac{\alpha e^2B^2}{m_e\nu_e m_A\nu_A}} \tag{16}$$

The desired aluminum collection velocity is the velocity normal to the collecting surface:

$$v_c = v_{Ay} + \beta v_{Ax} \approx \beta v_o - \frac{\beta v_o + \frac{k}{m_A\nu_A}\left[\frac{\alpha}{n_e}\delta_y(n_eT) + \frac{1}{n_A}\delta_y(n_AT)\right]}{1 + \frac{\mu_A B^2}{\eta n_A e}} \tag{17}$$

where $$\delta_y(n_AT) \approx \delta_x(n_AT) \approx \frac{\alpha n_A e}{k}\delta_x(\phi)$$

are of first order in $\beta$ so their products with first order quantities may be neglected.

and $$\eta \equiv \frac{m_e\nu_e}{\alpha\eta_a e^2} \tag{18}$$

$$\mu_A \equiv \frac{e}{m_A\nu_A} \tag{19}$$

Since the cross section for electron collisions with ions is very much larger than it is with neutral atoms, the former will control the resistivity when $\alpha$ is more than a few percent. The cross over from neutral to ionic collision occurs currently at about 4000°K. Extrapolating Spitzer's theory[9] for $\eta$:

$$\eta = \frac{261 \text{ ohm meter deg}^{3/2}}{T^{3/2}} = 7.4 \cdot 10^{-4} \text{ ohm meter for } T = 5000°\text{K} \quad (20)$$

For $T = 6000°$K and B = 3 webers/meter$^2$ and $\eta_A = 4.88.10^{23}$/meter$^3$ the parameter in the denominator of Eq. (17) becomes $$\frac{\mu_A B^2}{\eta n_A e} = 6.88 \cdot 10^{-3} \quad (21)$$

Thus Eq. (17) can be rewritten approximately as $$n_A v_c \approx \frac{\beta v_o \mu_A^{\wedge} B^2}{\eta e} - n_A \frac{k\mu_A}{e}\left[\frac{\alpha}{n_e}\delta_y(n_e T) + \frac{1}{n_A}\delta_y(n_A T)\right] \quad (22)$$

$$n_A v_c \approx \frac{\beta v_o \mu_A^{\wedge} B^2}{\eta e} - \frac{k\mu_A}{e}\delta_y(n_A T) \text{ for } \alpha << 1, \quad (23)$$

Equation (23), therefore gives the separation flux density of the aluminum relative to the oxygen.

Since the steady state flow of aluminum must be divergenceless, the average value of $n_A v_c$ is independent of $\gamma$ and it may be computed where $\delta_y(n_A T) = 0$, i.e. near the central surface of a separation region of the machine. In this region only the first term on the right of Eq. (23) is important. A strange thing can be seen in this case: the throughput rate is nearly independent of $\alpha$ the fractional ionization. It might have been assumed that since the force exerted on a mass of aluminum atoms by a given electric field is porportional to $\alpha$, their resulting velocity, $v_c$, would have been proportional to $\alpha$. However, the (small) electric field applied to the ions by the electrons goes like $1/\alpha$ in order that Eq. (12) may be satisfied. The resistivity $\eta$ is nearly independent of $\alpha$. Thus the lowest temperature, 4500°–5000°K, for which these conditions hold will be best, i.e. have lowest $\alpha$.

2. Charge Exchange

It has been determined that there is a very large resonant charge exchange cross section. Its important is that the ion and atom of aluminum can be regarded as a single species, as stated above. The cross section for resonant single charge transfer between an aluminum atom and a single charge aluminum ion is estimated from a formula using an adiabatic approximation.[6] Using this approach, it appears that the cross section for resonant single charge transfer between an aluminum atom and a singly charged aluminum ion is:

$1.73 \times 10^{-14}$sq cm at 5000°K

The foregoing equations can be used to predict accurately the performance characteristics of a separating apparatus such as shown in FIGS. 2 and 3.

The foregoing equations may also be solved to provide steady state solutions for the machine. To solve them apart from the use of a computer requires certain assumptions. In particular, the accumulation terms for mass, momentum and energy are neglected and, in most instances, the constancy of the transfer coefficients is assumed. The validity of these assumptions does not hold in all cases. But certain valid conclusions can be derived regarding machine size, magnetic field requirements, separation length in the effective bulk motion on the transfer process occurring during separation.

3. Entrance Effects

To calculate the rate at which a boundary layer develops near the entrance of a two-dimentional channel, an integral approximation may be used to solve the momentum equation in incompressible flow. It is concluded that provided the Hartmann number is in the order of 10 or larger, the entrance length may be neglected and the pressure gradient may be determined from a study of flow equations.

4. Drag

It is necessary to calculate the pressure gradient required to overcome the viscous and magnetofluid dynamic drag. The pressure gradient may be calculated as a function of the average flow velocity, $u_m$ and the applied magnetic field, B.

In a fully developed channel flow, the pressure $\bar{p}$ gradient may be computed from the following equation $$-\frac{\delta \bar{p}}{\delta \bar{x}} + 4\frac{\delta^2 \bar{u}}{\delta \bar{y}^2} - 4m^2\bar{u} = 0 \quad (24)$$

in dimensionless form.

Where $$\bar{x} = \frac{x}{a}\frac{1}{Re}$$

$$\bar{y} = \frac{y}{a}$$

$$\bar{u} = \frac{u}{u_m}$$

$$R_e = \frac{4aump}{\mu}$$

$$M = Ba\sqrt{\frac{\sigma}{\mu}} = \text{Hartmann number}$$

For fully developed flow, $$\frac{\delta \bar{p}}{\delta \bar{x}} = \text{constant.}$$

The boundary conditions are $$\bar{u} = 0 \text{ at } \bar{y} = 0$$

$$\bar{u} = 0 \text{ at } \bar{y} = 2 \quad (25)$$

The result is shown in FIG. 11.

5. Entrainment

One difficulty with the plasma reduction process described herein is the tendency of the ionized species to drag the neutral species along with it. Including the neutral gas motion leads, for large magnetic forces, to a modified picture of the separation process in which initially both species are pushed toward the same side as soon as the gas enters the magnetic field. Then the neutral gas diffuses back to its original distribution while the partly ionized specie continues to diffuse in the enrichment direction. This reduces initial collection velocities by about a factor of two.

The temperature of the wall is kept so high in the separator that the aluminum in the vapor phase does not condense until it leaves the separator.

6. Exemplary Process And Apparatus

The following equations represent gross approximations to solutions of the previously derived equations. However, they give relevant indications of scale, size and other operating parameters.

Before separation can occur, one species within the matter must be partly ionized. The ionization percentage must be much greater than that at which the frequency of electron momentum transfer collisions with atoms equals that with ions. When the former approximately equals or exceeds the latter, instabilities will prevent further separation. Ionization percentages exceeding the requirement stated above may be wasteful of energy if it occurs near walls as in the flow channel. For two parts aluminum in three parts oxygen, the condition is fulfilled at about 2% ionization. Use of lower grade clay inputs would increase by a factor f the dilution of aluminum. Thus, the temperature would have to be raised somewhat until the percentage ionization was $f \times 2\%$. This assumes comparable collision cross sections per atom; if the cross sections are larger, the percentage ionization would have to be increased still more. For the separation of matter other than aluminum compounds, the same kind of effect occurs. Large electron-atom cross sections require higher percentage ionizations. However, the percentage ionization should not have to go over 10% unless the concentration of the compound being separated drops below about 10 percent.

For the separation of aluminum, the apparatus shown in FIGS. 2 and 3 is fed from the feed bins with commercial grade alumina powder. The powder flows from the feed means 16 and 18 into the arc heaters and vaporizers. At this point it has reached the temperature of about 5,000°K where the gaseous vapor contains about 2% aluminum ions. Physical separation now begins.

In the first few decimeters, the aluminum and oxygen are both moved toward the wall 28 (FIG. 2) or the wall 80 (FIG. 3) with the magnetic force density from equation (1) with $\beta << 1$ $$\frac{M v_s B^2 \beta}{\eta} = \text{(e.g. 65 atmospheres/meter)} \tag{26}$$

Where:

$M$ = Mach No. (e.g. 0.5)

$v_s$ = speed of sound (e.g. 1735m/sec)

$B$ = magnetic field (e.g. 7.5 webers/m²)

$\beta$ = angle between flow and magnetic field direction (e.g. 0.1 radians)

$\eta$ = plasma resistivity (e.g. $7.4 \times 10^{-4}$ ohm meters)

The embodiment in FIG. 3 uses the inner wall 78 to confine the flow of the gaseous plasma. However, the magnetic pressure gradient for this example is sufficient to confine the plasma flow against the outer wall. Hence, no inner wall is illustrated in the embodiment of FIG. 2.

As shown in FIG. 2, the oxygen is allowed to escape from the central section of the apparatus from where it may be conducted to a calcining plant. There it may be cooled and exhausted as a by-product. The aluminum continues to be held to the wall by the magnetic force density as the oxygen diffuses out of it. As the oxygen pressure inside the velocity stream is relieved and the Mach number increases, the aluminum will compress to about 40% of its original channel width and 75% of the aluminum will be contained in 20% of the original channel width. The enriched aluminum flows along the wall into the collection region defined by receptacle 32 where it is condensed. It should be indicated that channel widths of the input stream of plasma and gas is on the order of a decimeter.

The exemplary magnetic field stabilizes the gaseous flow to transverse Reynolds numbers of about 6,000. However, a better approach is to take the Reynolds number at a substantially lower value as such:

$$R_e = \frac{M v_s \omega}{\nu} \leq 3{,}000 \tag{27}$$

where $\omega$ is the channel width $\nu$ is the kinematic viscosity

The pressure drop through the separator should be nearly as great as the inlet pressure in order to get the greatest effectiveness out of the inlet pressure and reduce unnecessary thermal loading of the walls. Thus, it can be stated that outlet pressure is as follows:

$$P_{out} << P_{in} \tag{28}$$

The production rate R for a machine is determined according to the following formula:

$$R = \frac{0.75\pi\, M v_s\, 0.4\, P_{in}\, m_a w}{k^T} \underline{\bar{X}} = \frac{100 \text{ tons}}{\text{day meter}} M \left(\frac{w}{\text{cm}}\right)\left(\frac{P_{in}}{\text{atoms.}}\right) \underline{\bar{X}} \tag{29}$$

where $\underline{\bar{X}}$ is the diameter of the machine $m_a$ is the mass of an aluminum atom The factor 0.75 represents 75% collection utilizing a collector having a width equal to 0.2w (channel width).

The factor 0.4 is the atomic fraction of aluminum

The channel width is determined using equations (29) and (27) to yield $$w = \frac{10^{-2} \text{ cm atm}}{M\, P_{in}\, \underline{\bar{X}}} \left(\frac{R}{\text{tons/day } m}\right) \tag{30}$$

and $$w \leq \frac{3.9 \text{ cm atm}}{M\, P_{in}} \tag{31}$$

The height of the separating section 76 is determined in the following manner:

$$\text{Oxygen flux density} = n_o \left(\frac{0.2\, w}{\tau}\right) \sim \frac{2D\, n_o}{W} \tag{32}$$

where

D is the diffusion coefficient of oxygen through aluminum vapor, $$D = \frac{\lambda \bar{v}}{3} \approx 0.02 \frac{m^2}{\text{sec}} \frac{\text{atmos}}{P_{in}} \quad (33)$$

where $\lambda$ is the mean free path for momentum transfer between an oxygen atom and the aluminum atoms ≈ 10 micrometers at one atmosphere total average pressure, $(P_{in}/2)$ $\bar{v}$ is the mean collision speed between oxygen and aluminum atoms ≈ 3 km/sec $n_o$ is the average density of oxygen in the channel = $9.10^{17}/\text{cm}^3$ at one atmosphere total pressure and $\tau$ is the diffusion time The factor of 0.2 multiplying w represents the fact that for 75% collection of aluminum, the oxygen needs to diffuse only a distance = 0.2 w.

From Equations (32) and (33)

$$\lambda \approx \frac{w^2}{10D} \approx \frac{4 \cdot 10^{-8} \text{ atm}}{M^2 P_{in}} \left(\frac{R}{\text{tons/day m}}\right)^2 \quad (34)$$

and the height of the separator is $$H \approx 2Mv_s \tau \approx \frac{10^{-4} \text{ meter atms.}}{M P_{in}} \left(\frac{R}{\text{tons/day m}}\right)^2 \quad (35)$$

where $v_s$ is the speed of sound = 2 km/sec.

The factor of 2 is to account for the fact that the average Mach number exceeds the inlet Mach number, M.

The magnetic field required to establish the initial compression of the inlet gases against the outer wall is given by:

$$B = \frac{10 P \text{ webers/m}^2}{\text{atmos. } \sqrt{\beta R \text{ m day/ton } \bar{X}}} \quad (36)$$

The flow angle is calculated in the following manner.

The pressure drop needed to force the gas against the electromagnetic drag is given by:

$$\frac{2Mv_s B^2 \beta^2}{\eta} \approx \frac{P_{in}}{H} \quad (37)$$

$$R \approx \frac{0.7 \bar{X} \text{ tons/m day}}{\beta} \quad (38)$$

Thus, the production rate per meter is uniquely determined by the flow angle $\beta$. Substituting Eq. (38) into equation (36) yields:

$$B \approx \frac{20 P_{in} \text{ webers/m}^2}{\text{atmospheres}} \quad (39)$$

Obviously, the larger the magnetic field B, the better the operation of the process. However, there are limitations. Costs mount rapidly beyond about 7 webers/$m^2$. However, this is subject to the advance of technology. Still further, magnetic pressure becomes dangerous and causes structural problems much above 7 webers/$m^2$. Magnetic pressure at that field strength is 190 atmospheres.

It should also be noted that equation (39) provides a means for determining input pressure $P_{in}$.

$$\beta = w/H \quad (40)$$

Preferably, the angle $\beta$ between the flow direction and the magnetic field B should be limited to less than 15° in order to achieve small electromagnetic drag. It should be greater than 0 in order to limit the height of the separator. The preferred range is between 2° and 8°.

The foregoing figures were calculated to two places and rounded off to one so some apparent inconsistency may be noted.

The foregoing shows that such a machine is capable of producing aluminum at rates of tens of tons per day in an apparatus whose dimensions are measured in meters and using moderate flow rates.

VI. HEATING AND VAPORIZATION OF THE MATTER

A. The Arc Heater

It is apparent from what has been stated heretofore that the matter from which a constituent is to be separated must be heated to form a vapor (gas) and that the selected constituent be partly ionized. A means of heating is disclosed using a rotating arc.

It is necessary to heat alumina ($Al_2O_3$) to about 4,000°K to cause it to vaporize. It is known that electrical discharges can supply sufficient energy to cause such heating. See Varney U.S. Pat. No. 1,954,900. The problem with electrical discharge heating is that it is difficult to maintain the particles being heated within the arc long enough to acquire sufficient energy. In accordance with what is disclosed herein, an arc is rotated to define a cone. The solid particles are retained within the cone until they are vaporized. Upon vaporization, they pass through the cone.

There are two basic enthalpy transfer problems encountered in trying to use an electric arc as a source of heat. First, because the gas and the particles entrained therein are heated as they approach an arc, the density of the gas and particles is reduced as it approaches the arc. The result is that most of the mass flow tends to avoid the discharge channel. Second, the time during which the material (gas and solid particles) to be heated is in the vicinity of the arc (the residence time) must be relatively long if a refractory material such as $Al_2O_3$ is to be vaporized and dissociated.

In a high speed gas flow heater, with short residence times, refractory materials can be vaporized only if they pass through a part of discharge volume where the gas, at the moment, is dissociated. This is necessary for large enthalpy transfer to the solid or liquid. Plasma jets are not well suited for this heating task. The difficulties are short residence time and getting an appreciable proportion of the material into intimate association with the arc and the dissociated gas. A rotating arc, however, meets and overcomes this problem.

The arc heater referred to in discussion of FIG. 2 is shown in FIG. 13. The heater includes a cathode 100 positioned along the axis of a cylindrical chamber defined by the wall 104. An annular anode 102 is mounted in the chamber wall 104 and spaced axially from the cathode 100. The chamber wall 104 is surrounded by an electrically conductive solenoid coil which generates a uniform magnetic field $\vec{B}_o$, parallel to the axis of the chamber. The effect of the magnetic field $\vec{B}_o$ is to interact with the arc current to force the arc 106 to rotate. The rotating arc 106 in effect defines a conical arc wall. To provide uniform heating of all of the feed material, the time for one revolution of the arc must be considerably less than the time required for the material to pass through the region being heated by the arc.

The rotating arc is effectively a cone of highly ionized plasma having a temperature in excess of 5000°K. The wall is approximately 3 mm. thick. The interaction of the magnetic field $\vec{B}_o$ with the arc current $\vec{I}$ to generate a force ($\vec{B}_o \times \vec{I}$) is sufficient to rotate the arc at between 6,000 to 12,000 r.p.m. At 12,000 r.p.m. the rotating arc will pass through each point in the conical arc wall 200 times per second. For reasons explained hereinafter, the solid and liquid feed material will see the rotating arc as a solid wall. The structural wall 104 is made of a highly thermally insulating material or is convectively cooled as described hereinafter.

In the example shown, the material being fed is alumina ($Al_2O_3$) particles which may have been preheated by oxygen to liquid droplets.

The arc wall created by rotating arc 106 functions to keep all solid and liquid particles in Zone II until they are vaporized. The vaporization of material in Zone II provides sufficient pressure to cause the gas and vapor to flow out of Zone II into Zone III and thence into the separating apparatus 26 shown in FIG. 2.

The conical rotating arc provides a sufficiently long residence time to vaporize solid particles because the vaporization of the leading edge of the particles supplies a force that pushes the particles away from the arc. Thus, the particle will not pass through the arc until it is completely vaporized.

The plasma arc generated between the cathode 100 and the annular anode 102 has a temperature greater than 10,000°K. At a predetermined elevation above the arc, a generally spherical particle enters at a negligible initial velocity. The particles are moving downward under the influence of gravitational force and drag exerted by the ambient gas. When the particle comes in contact with the plasma arc, heat is being transferred from the arc to the particle through the contact surface of the particle. If the heat transfer rate is fast enough, and the downward motion of the particle slow enough, the particle is partially vaporized. The vapor is released from the contact surface of the particle. This vapor ejection exerts a thrust on the particle away from the arc. Thus, the motion of the particle is governed by the gravitational force, drag force, and the thrust due to vapor ejection.

The force due to the escaping vapors eject particles up to several tens of micrometers diameter back out of the arc. Thus, the particle is trapped above the arc until complete vaporization takes place.

B. Equilibrium Composition Of The Gaseous Mixture

Fundamental to the operation of the present process is the fact that certain elements will at least partly ionize at a temperature where there is no significant ionization of the other constituent elements. Stated otherwise, the process operates upon the existence of a major ionic species among other neutral elements within a high temperature gaseous mixture. Specific mention has already been made of the ionization of aluminum from the gaseous mixture of vaporized $Al_2O_3$. Reference is made to FIG. 4 wherein the equilibrium composition for a gaseous mixture of 40 atomic % aluminum and 60 atomic % oxygen at 1 atmosphere is shown. FIG. 4 also shows that the suboxides $Al_2O_2$, $Al_2O$ and A10 also exist at the low temperature ranges. The vapor leaving this arc must have a low temperature (4000°K) so as not to be ionized until it is positioned in the separation channel where another arc heats it up to ~2% ionization (5000°K).

Since the present invention has equal applicability to other compounds where a major ionic specie in a gaseous mixture can be created, equilibrium compositions for different metal ores are shown in FIGS. 5–10. FIG. 5 plots the equilibrium composition of Hematite ($Fe_2O_3$) at 1 atmosphere. FIG. 7 plots the equilibrium composition of Bunsenite (NiO) at 1 atmosphere. And FIG. 6 plots the equilibrium composition of Tenorite (CuO) at 1 atmosphere. FIG. 10 plots the equilibrium composition of ($Al_2SiO_5$). FIG. 9 plots the equilibrium composition of Pentlandite ($FeNiS_4$). FIG. 8 plots the equilibrium composition of Cassiterite ($SnO_2$) at 1 atmosphere.

V. COOLING AND CONTAINMENT

It is apparent that the wall 28 for the separation section requires special design considerations because of the high temperatures present. The same is true of the wall 104 in the arc heaters. There are few materials which do not melt at temperatures above 3,000°K and which can withstand oxidation at these temperatures. There are even a lesser number of materials which do not form eutectics or lower melting solutions with alumina or aluminum. Disclosed herein are three walls which can house the separator section. The first is a replacable ablative wall. The second is a porous wall cooled by transpiration of a liquid forced through it. The liquid is made of the same materials as are being treated. The third is a wall cooled by convection.

When a metallic ore is to be reduced, the walls or a coating on the walls of the separating section and, where required, other parts of the apparatus, should be made of that particular ore or of one or more constituents of the ore. This is so that the wall itself or its coating will not contaminate the process if it evaporates (ablates) or is in a steady state equilibrium with the vapor.

Although it is desirable to have the walls containing the hot partially ionized gases of the ore made of a material which is solid at the temperature of operation, for most ores, including aluminum, the wall surface would have to be at about the boiling point of the ore and hence in the liquid state. At the boiling point of most ores, there are few materials that remain solid and do not react with the vaporized ore. Alumina boils at 3800°–4000°K. Thus, the present invention contemplates providing a liquid wall surface for containing the hot vaporized ores.

Such a wall can take three forms. The first is to provide a solid wall made of the compound (e.g. a solid $Al_2O_3$ wall) supported from the outside. The inside of the wall melts and becomes liquid. Evaporation from this liquid limits the temperature of the inside surface. The solid material is replaced continuously or periodically.

This is illustrated in FIG. 14 where ablative wall 200 for the separation section of an apparatus operated in accordance with the present invention is illustrated. As shown, the wall 200 is made of the same material as the compound being processed. In the case of $Al_2O_3$, the wall 200 may be made of alumina. As shown, the inside of the wall is coated with a condensate layer 202 past which the gas and plasma is flowing.

If desired, a mechanism for replacing the wall can be provided. Such mechanism could provide for constantly forcing the wall 200 downwardly with new wall material as it is worn away.

It should be pointed out that the magnetic coil will preferably be surrounded by a thick layer of powdered material to provide high thermal resistivity. Almost any conventional heat insulating powdered material can be used for this purpose.

The second type of wall which may be used is one which is cooled by a liquid (e.g. $Al_2O_3$ or $Al_2O_3$+ Al) forced through a porous solid. This is transpiration cooling; that is, the temperature of the wall is limited by evaporation.

FIG. 15 shows a wall 220 cooled by transpiration cooling. As shown, the wall is made of a porous material 228 so that the liquid used to absorb the incident heat flux by its evaporation may flow therethrough. The material 228 may be, by way of example, sintered tungsten or molybdenum. The liquid is fed to the wall 220 through conduits 222, 224 and 226 from a preheater (not shown). The liquid flows under pressure through the porous portion of the wall 228 and down with the plasma and gas toward the collection region.

Since the liquid must not contaminate the plasma and gas, only the material being reduced or one of its constituents can be used as the transpiration cooling liquid. In the case where alumina is being reduced, the liquid must either be Al, $Al_2O_3$ or a solution of Al and $Al_2O_3$. The use of pure aluminum is not desirable because too much aluminum is consumed to dissipate the heat flux compared to the aluminum produced. Pure $Al_2O_3$ is not suitable as a cooling liquid because its boiling point is too high. Pure alumina boils at some point between 3800°K and 4036°K. However, a mixture of aluminum and alumina can be used because the aluminum lowers the boiling point of the alumina sufficiently to be compatible with a wall material made of molybdenum or tungsten.

The third type of wall shown in FIG. 16 functions by maintaining a steady state with respect to evaporation and condensation of the vaporized ore. This is controlled by convective cooling of the outer surface of the wall.

The convectively cooled wall 240 is shown in FIG. 16. As shown, the wall consists basically of a material 242 that is compatible with the compound being separated. In the case of alumina, the wall material 242 could be tungsten or molybdenum coated with aluminum oxide. If desired, the wall 242 could be backed by a porous material through which a gaseous coolant, such as air, is forced. The coolant channel is closed by the wall 244.

Pretreatment Of The Matter

Since available ores contain differing amounts of impurities, they may have to be pretreated. In particular, the ore must be finely ground to a small particle size (10–100 micrometers) in order to obtain efficient heating in the arc heater. Calcining to remove water or other volatile components can be accomplished using the energy carried by exhaust gases such as oxygen.

If one of the impurities in the ore is another metal or an element that shows a degree of ionization approximately equal to that of the selected metal to be separated, then the pretreatment process must include some method of separating this impurity. However small percentages of metallic impurities will have their ionization suppressed by the ionization of the major metallic component being separated. Thus the system does tolerate rather high metallic impurity concentration in the ore without pre-purification.

VI. REFERENCES

1. Varney U.S. Pat. No. 1,954,900 issued Apr. 17, 1934.
2. H. D. Smyth, *Atomic Energy for Military Purposes* (Princeton University Press, Princeton, N.J., 1945), pp. 187–188, 191–192, 195–196.
3. B. Bonnevier, Experimental Evidence of Element & Isotope Separation in a Rotating Plasma, Royal Institute of Technology Report No. 70-08, June 11, 1970.
4. P. H. Schmidt, V. L. Granatstein, B. J. Eastlund, and R, F. Leheny, Alkali Metal Purification by Preferential Contact Ionization in a Magnetoplasma Device, J. Appl. Phys. 38, 4919 (1967).
5. Rains and Kadlec, The Reduction of $Al_2O_3$ to Aluminum in a Plasma, Metallurgical Transactions, Volume 1, pp. 1501–1506, June 1970.
6. O. Firsov, J. Exp. Theor. Phys. 21, 1001 (1951).
7. Dushman and Lafferty, Scientific Foundations of Vacuum Technique, (Wiley, New York, 2nd Edition, 1962) page 14.
8. Landau & Lifshitz, *Statistical Physics*, Pergamon Press, 1958) pp. 322–324.
9. L. Spitzer, Physics of Fully Ionized Gases, 2nd Ed., 1939, pp. 127, 139

Other References

10. "Aluminum" in McGraw-Hill Encyclopedia of Science & Technology, Vol. 1, pp. 292–294.
11. C. Bonet, R. Delmas, and M. Foex, High Power Plasma Flows, *Proc. Int. Conf. Gas Discharges,* 15–18 September 1970, pp. 236–240.
12. B. Ahlborn, On the Temperature & Velocity Determination of Plasma Flow from a Plasma Burner, Z. Naturforschung 20a, 466 (1965).
13. E. W. McDaniel, *Collision Phenomena in Ionized Gases* (Wiley, New York, 1964), pp. 242, 446–446.
14. E. V. Condon and H. Odishaw, Handbook of Physics, 1958, Section 5, pp. 12–13; Section 3, pp. 26–39.
15. L. Pauling, *Nature of the Chemical Bond* (Cornell University Press, New York, 1960), 3rd Ed., p. 224.
16. B. J. Eastlund and W. C. Gough, "The Fusion Torch — Closing the Cycle from Use to Reuse (U.S. Atomic Energy Commission, Wash. —1132, May 1969).

United States Patents

| | | |
|---|---|---|
| 2,616,843 | SHEER ET AL | 11/4/52 |
| 2,734,016 | SHEER ET AL | 2/14/56 |
| 2,836,750 | WEINER | 5/27/58 |
| 2,842,490 | FRIEL | 7/8/58 |
| 2,919,370 | GIANNINI ET AL | 12/29/59 |
| 2,944,140 | GIANNINI ET AL | 7/5/60 |
| 3,004,137 | KARLOVITZ | 10/10/61 |

United States Patents-continued

| | | |
|---|---|---|
| 3,088,044 | BUCHHOLD | 11/7/61 |
| 3,195,217 | JOHN | 7/20/65 |
| 3,232,746 | KARLOVITZ | 2/1/66 |
| 3,271,556 | HARRIS | 9/6/66 |
| 3,283,205 | DE BOLT | 11/1/66 |
| 3,429,691 | McLAUGHLIN | 2/25/69 |
| 3,475,158 | NEUENSCHWANDER | 10/28/69 |
| 3,480,426 | NEUENSCHWANDER | 11/25/69 |
| 3,541,625 | BURGGRAAF | 11/24/70 |
| 3,586,613 | STEWART | 6/22/71 |

We claim:

1. The process of separating from each other a specie and the remaining species in a gas comprising all of the species, said gas being at a temperature where the specie is partly ionized and the remaining species are insignificantly ionized, comprising:

a. directing said gas through a magnetic field $\vec{B}$ at a velocity $\vec{v}$;

b. orienting said magnetic field $\vec{B}$ relative to said directed gas velocity $\vec{v}$ such that the vectors $\vec{v}$ and $\vec{B}$ define an angle $\beta$ between them;

c. permitting the current $\vec{I}$ created by the interaction of the moving electrons of the ionized specie with the perpendicular component of the magnetic field $\vec{B}_{\perp}$ to flow in a closed path;

d. using said current I flowing in a closed path to interact with the parallel component $\vec{B}_{\parallel}$ of the magnetic field $\vec{B}$ to generate a force F upon the partly ionized specie to cause both ionized and neutral particles of said partly ionized specie to move at an angle to the direction of movement of the gas; and e. collecting the selected specie apart from the gas.

2. The process of separating from each other a specie and the remaining species in a gas comprising all of the species, said gas being at a temperature where the specie is partly ionized and the remaining species are insignificantly ionized, comprising:

a. creating relative movement between the gas and a magnetic field $\vec{B}$ such that the direction of said relative movement is at an angle $\beta$ with respect to the vector direction of said magnetic field $\vec{B}$;

b. permitting the current $\vec{I}$ created by the interaction of the electrons of the ionized specie with the perpendicular component of the magnetic field $\vec{B}_{\perp}$ to flow in a closed path;

c. using said current $\vec{I}$ flowing in a closed path to interact with the parallel component of the magnetic field $\vec{B}_{\parallel}$ to generate a force $\vec{F}$ upon the partly ionized specie to cause both ionized and neutral particles of said partly ionized specie to move away from said gas; and d. directing the selected specie away from the gas.

3. The process of separating from each other a specie and the remaining species in a composition of matter comprising all of the species, comprising:

a. heating said composition of matter to a temperature where it is in a gaseous state and the specie is partly ionized;

b. directing said gaseous composition of matter through a magnetic field $\vec{B}$ at a velocity $\vec{v}$;

c. orienting said magnetic field $\vec{B}$ relative to said velocity $\vec{v}$ such that the vectors $\vec{v}$ and $\vec{B}$ define an angle $\beta$ between them;

d. permitting the current $\vec{I}$ created by the interaction of the moving electrons of the ionized specie with the perpendicular component of the magnetic field $\vec{B}_{\perp}$ to flow in a closed path;

e. using the current $\vec{I}$ flowing in a closed path to interact with the parallel component of the magnetic field $\vec{B}_{\parallel}$ to generate a force $\vec{F}$ upon the partly ionized specie to cause both ionized and neutral particles of the partly ionized specie to move at an angle to the direction of movement of the gaseous composition of matter; and f. directing the selected specie away from the remainder of the gaseous composition of matter.

4. The process of separating a metal element from the remaining elements in a compound of that metal, comprising:

a. heating said compound to a temperature where it is in a gaseous state and only the metal element is significantly ionized;

b. directing the gaseous compound through a magnetic field $\vec{B}$ at a velocity $\vec{v}$;

c. orienting said magnetic field $\vec{B}$ relative to said velocity $\vec{v}$ such that the vectors $\vec{v}$ and $\vec{B}$ define an angle $\beta$ between them;

d. permitting the current $\vec{I}$ created by the interaction of the moving electrons of the partly ionized metal element with the perpendicular component of the magnetic field $\vec{B}_{\perp}$ to flow in a closed path;

e. using said current $\vec{I}$ flowing in a closed path to interact with the parallel component $\vec{B}_{\parallel}$ of the magnetic field $\vec{B}$ to generate a force upon the partly ionized metal element to cause both ionized and neutral particles of said partly ionized metal element to move at an angle to the direction of movement of the gaseous compound and f. collecting the metal element apart from the gas.

5. The process of separating a metal element from the remaining elements in a compound of that metal in accordance with claim 4 wherein aluminum is separated from an aluminum compound.

6. The process of separating a metal element from the remaining elements in a compound of that metal in accordance with claim 4 wherein iron is separated from an iron compound.

7. The process of separating a metal element from the remaining elements in a compound of that metal in accordance with claim 4 wherein copper is separated from a copper compound.

8. The process of separating a metal element from the remaining elements in a compound of that metal in accordance with claim 4 wherein nickel is separated from a nickel compound.

9. The process of separating a metal element from the remaining elements in a compound of that metal in accordance with claim 4 wherein tin is separated from a tin compound.

10. The process of separating a metal from the remaining elements in a compound of that metal in accordance with claim 4 wherein titanium is separated from a titanium compound.

11. The process of separating aluminum from the remaining elements in an aluminum compound comprising:

a. heating said aluminum compound until it is in a gaseous state and at a temperature where the aluminum and other elements in the compound are dissociated and only the aluminum is partly ionized;

b. directing the gaseous aluminum compound through a magnetic field $\vec{B}$ at a velocity $\vec{v}$;

c. orienting said magnetic field $\vec{B}$ relative to said velocity $\vec{v}$ such that the vectors $\vec{v}$ and $\vec{B}$ define an angle $\beta$ between them;

d. permitting the current $\vec{I}$ created by the interaction of the moving electrons of the partly ionized aluminum with the perpendicular component of the magnetic field $\vec{B}_{\perp}$ to flow in a closed path;

e. using said current $\vec{I}$ flowing in a closed path to interact with the parallel component $\vec{B}_{\parallel}$ of the magnetic field $\vec{B}$ to generate a force upon the partly ionized aluminum to cause both ionized and neutral particles of said partly ionized aluminum to move at an angle to the direction of movement of the gaseous compound; and f. collecting the aluminum apart from the gaseous ore.

12. The process of separating aluminum from the remaining elements in an aluminum compound in accordance with claim 11 wherein the compound is alumina.

13. The process of separating aluminum from the remaining elements in an aluminum compound in accordance with claim 11 wherein the compound is aluminum silicate.

14. The process of separating a selected specie element from the remaining specie elements in a composition of matter comprising all of the species, comprising:

a. heating the composition of matter until it is in a gaseous state and the specie elements are dissociated;

b. said heating being sufficient to significantly ionize only the selected specie element;

c. said selected specie element being heated to a temperature where it is partially ionized such that the number of neutral particles of the selected specie element exceed the number of ionized particles of the selected specie element;

d. forcing the partly ionized selected specie element out of the gas by directing the gas through a magnetic field $\vec{B}$ at a velocity $\vec{v}$ with the magnetic field $\vec{B}$ oriented relative to the direction of movement of said gas such that the vectors $\vec{v}$ and $\vec{B}$ define an angle $\beta$ between them; and e. directing the selected specie away from the gas.

15. The process of separating a selected specie element from the remaining specie elements in accordance with claim 14 wherein only a small percentage of the particles of the selected specie element are ionized.

16. The process of separating a selected specie element from the remaining species elements in accordance with claim 14 wherein the composition of matter is an aluminum compound and the specie element is aluminum.

17. The process of separating a selected specie element from the remaining specie elements in accordance with claim 14 wherein the composition of matter is a titanium compound and the specie element is titanium.

18. The process of separating a selected specie element from the remaining specie elements in accordance with claim 14 wherein the composition of matter is a tin compound and the specie element is tin.

19. The process of separating a selected specie element from the remaining specie elements in accordance with claim 14 wherein the composition of matter is a nickel compound and the specie element is nickel.

20. The process of separating a selected specie element from the remaining specie elements in accordance with claim 14 wherein the composition of matter is a copper compound and the specie element is copper.

21. The process of separating a selected specie element from the remaining specie elements in accordance with claim 14 wherein the composition of matter is an iron compound and the specie element is iron.

22. The process of separating from each other a specie and the remaining species in a gas in accordance with claim 2 wherein the specie is partly ionized to 1–2%.

23. The process of separating from each other a specie and the remaining species in a gas in accordance with claim 2 wherein the specie is partly ionized to greater than 1–2% but less than 10%.

24. The process of separating from each other a specie and the remaining species in a gas in accordance with claim 2 wherein the ionization potential of the specie is less than the ionization potential of the remaining species.

25. The process of separating from each other a specie and the remaining species in a gas in accordance with claim 2 including flowing of the gas through a structure having axial symmetry so that said current I can flow in a closed path.

26. The process of separating from each other a specie and the remaining species in a gas in accordance with claim 2 wherein the angle $\beta$ is greater than 0° and less than 15°.

27. The process of separating from each other a specie and the remaining species in a gas in accordance with claim 2 wherein the angle $\beta$ is between 2° and 8°.

28. The process of separating a selected specie element from the remaining specie elements in a composition of matter, comprising:

a. heating the composition of matter until it is in a gaseous state and at a temperature where only the specie is partly ionized and the remaining species are insignificantly ionized;

b. said selected specie element being heated to a temperature where it is partially ionized such that the number of neutral particles in the selected specie element exceed the number of ionized particles of the selected specie element;

c. forcing the partly ionized selected specie element out of the gas by directing the gas through a magnetic field $\vec{B}$ at a velocity $\vec{v}$ with the magnetic field B oriented relative to the direction of movement of said gas such that the vectors $\vec{v}$ and $\vec{B}$ define an angle $\beta$ between them;

d. permitting the current $\vec{I}$ created by the interaction of the electrons of the ionized specie with the perpendicular component of the magnetic field $\vec{B}$ to flow in a closed path;

e. using said current $\vec{I}$ flowing in a closed path to interact with the parallel component of the magnetic field $\vec{B}$ to generate a force $\vec{F}$ upon the electrons whereby the electron movement as a result of such force creates an electric field due to the separation between the ions in the specie element, and the force created by said electric field upon said ions pulls the ions after the electrons in the direction of movement created by the force acting upon the electrons; and f. directing the selected specie away from the gas.

* * * * *